US007620357B2

(12) United States Patent
Shakuto et al.

(10) Patent No.: US 7,620,357 B2
(45) Date of Patent: Nov. 17, 2009

(54) IMAGE FORMING APPARATUS WITH OBTUSE-EDGE CLEANING BLADE

(75) Inventors: Masahiko Shakuto, Zama (JP); Osamu Naruse, Yokohama (JP); Hidetoshi Yano, Yokohama (JP); Kazuhiko Watanabe, Koganei (JP)

(73) Assignee: Ricoh Company, Ltd., Tokyo (JP)

( * ) Notice: Subject to any disclaimer, the term of this patent is extended or adjusted under 35 U.S.C. 154(b) by 350 days.

(21) Appl. No.: 11/472,350

(22) Filed: Jun. 22, 2006

(65) Prior Publication Data

US 2007/0003337 A1 Jan. 4, 2007

(30) Foreign Application Priority Data

Jun. 27, 2005 (JP) ..... 2005-187054

(51) Int. Cl.
*G03G 21/00* (2006.01)

(52) U.S. Cl. ..... 399/350; 399/349; 399/354

(58) Field of Classification Search ..... 399/349, 399/350, 353, 354

See application file for complete search history.

(56) References Cited

U.S. PATENT DOCUMENTS

| | | | | |
|---|---|---|---|---|
| 2002/0009314 | A1* | 1/2002 | Nakayama | 399/297 |
| 2002/0009316 | A1* | 1/2002 | Endo et al. | 399/349 |
| 2003/0086738 | A1* | 5/2003 | Sakanobe et al. | 399/350 |
| 2003/0235424 | A1* | 12/2003 | Kawahara et al. | 399/71 |
| 2005/0254856 | A1* | 11/2005 | Miura et al. | 399/159 |

FOREIGN PATENT DOCUMENTS

| | | |
|---|---|---|
| JP | 5-19671 | 1/1993 |
| JP | 5-158384 | 6/1993 |
| JP | 2001-235989 | 8/2001 |
| JP | 2003-167492 | 6/2003 |
| JP | 2004-325621 | 11/2004 |
| JP | 2006-154747 | 6/2006 |
| JP | 2006-195348 | 7/2006 |
| JP | 2006-259466 | 9/2006 |
| JP | 2006-259547 | 9/2006 |

OTHER PUBLICATIONS

U.S. Appl. No. 12/031,333, filed Feb. 14, 2008, Sugimoto et al.
U.S. Appl. No. 12/030,608, filed Feb. 13, 2008, Sugimoto et al.
U.S. Appl. No. 12/109,648, filed Apr. 25, 2008, Hozumi et al.
U.S. Appl. No. 12/137,158, filed Jun. 11, 2008, Naruse et al.

* cited by examiner

*Primary Examiner*—David M Gray
*Assistant Examiner*—Joseph S Wong
(74) *Attorney, Agent, or Firm*—Oblon, Spivak, McClelland, Maier & Neustadt, L.L.P.

(57) ABSTRACT

An image forming apparatus of the present invention includes a cleaning brush positioned upstream of a blade nip in the direction of movement of the surface of a photoconductive drum. To prevent toner from accumulating at the blade nip, the surface of the photoconductive drum is moved in the direction opposite to the regular direction for image formation, conveying toner accumulated in a wedge-shaped space upstream of the blade nip 2*n* to a position where the cleaning brush removes it. With this configuration, the image forming apparatus can stably clear spherical toner particles left on the drum over a long period of time.

17 Claims, 23 Drawing Sheets

CIRCUMFERENTIAL LENGTH C1
PROJECTED PARTICLE AREA S

CIRCLE WITH AREA S
CIRCUMFERENTIAL LENGTH C2

IMAGE FORMING APPARATUS WITH OBTUSE-EDGE CLEANING BLADE

BACKGROUND OF THE INVENTION

1. Field of the Invention

The present invention relates to a copier, facsimile apparatus, printer or similar image forming apparatus and more particularly to a cleaning device included in an image forming apparatus for removing toner particles left on the surface of an image carrier after image transfer.

2. Background of the Invention

A cleaning device of the type removing toner particles left on the surface of a photoconductive drum or similar image carrier with a cleaning blade is extensively used in image forming apparatuses. The cleaning blade is, in many cases, formed of metal or rubber or similar elastic material.

A cleaning blade formed of metal has a drawback that the edge portion of the blade, contacting the surface of the image carrier, deforms little and therefore fails to closely contact the surface of the image carrier if the machining accuracy of the edge portion is low or if fine irregularities exist on the above surface. As a result, toner grains are apt to slip through a small gap formed between the edge portion of the cleaning blade and the surface of the image carrier, bringing about defective cleaning.

By contrast, a cleaning blade formed of rubber or similar elastic material has an edge portion deformable along the surface of an image carrier and can therefore closely contact the surface of the image carrier even if the machining accuracy of the edge portion is relatively low or even if fine irregularities exist on the above surface. Such a cleaning blade allows a minimum of toner grains to slip thereby and is therefore higher in cleaning ability than a cleaning blade formed of metal. For this reason, a cleaning blade formed of rubber or similar elastic material is predominant over one formed of metal. An image forming apparatus using an elastic cleaning blade is disclosed in, e.g., Japanese patent laid-open publication Nos. 2004-325621 and 2003-167492.

Today, an image forming apparatus of the type using toner, having a substantially spherical shape and produced by polymerization or similar technology, is known in the imaging art. It is generally accepted that substantially spherical toner (simply spherical toner hereinafter) promotes efficient image transfer more than conventional pulverized toner irregular in shape and can meet the increasing demand for higher image quality.

However, the problem with spherical toner is that it cannot be sufficiently removed from the surface of an image carrier by a conventional cleaning blade configured to remove pulverized toner, resulting in defective cleaning.

SUMMARY OF THE INVENTION

It is an object of the present invention to provide a cleaning device capable of stably removing spherical toner from an image carrier with a cleaning blade provided with an obtuse-angled edge.

An image forming apparatus of the present invention includes a toner image carrier whose surface is movable while carrying a toner image thereon. A cleaning unit includes a cleaning blade held in contact with the surface of said toner image carrier in a counter direction for removing toner particles left on the surface. A toner accumulation preventing device prevents the toner from accumulating at a blade contact portion where the toner image carrier and cleaning blade contact each other. The toner, forming the toner image, comprises spherical toner having circularity of 0.98 or above. Further, two surfaces of the cleaning blade, forming a ridge line contacting the image carrier, form an obtuse edge angle.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

To better understand the present invention, conventional technologies and problems thereof will be described first.

We conducted a series of experiments in order to make clear the mechanism of defective cleaning ascribable to spherical toner slipped by a cleaning blade, as will be described hereinafter.

Figure 1:
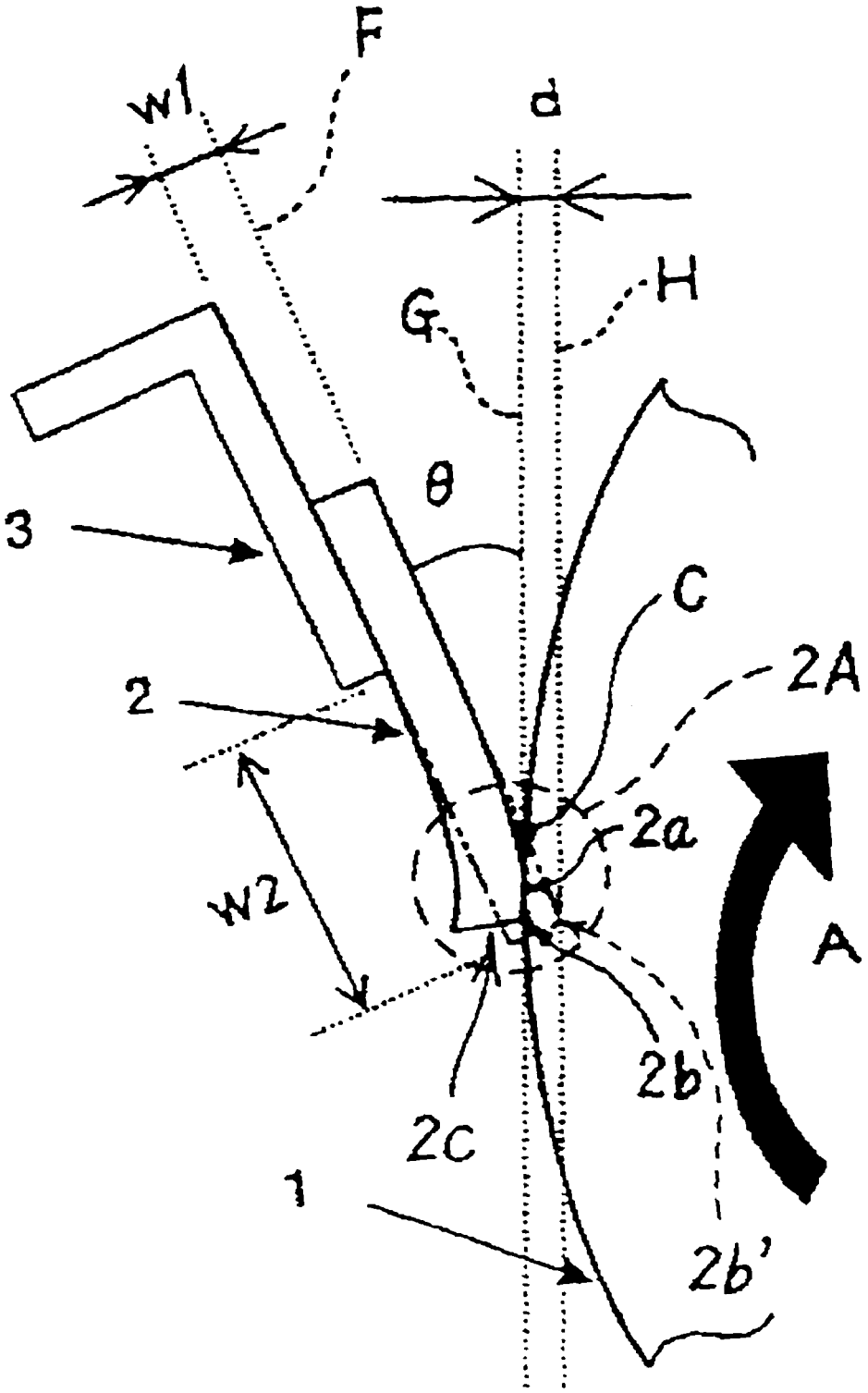
FIG. 1 shows a position of a cleaning blade relative to a photoconductive drum.

FIG. 1 shows a photoconductive drum 1, which is a specific form of an image carrier or toner image carrier, and a cleaning blade 2 contacting it. As shown, the cleaning blade 2 has an edge portion 2A contacting the surface of the drum 1 in a direction counter to the direction of rotation A of the surface of the drum 1. The initial contact angle of the cleaning blade 2 with the drum 1 is θ while the amount of bite of the former into the latter is d.

To define the initial contact angle θ mentioned above, assume a virtual blade line F representative of a plane in which the surface of the cleaning blade 2 would face the drum 1 (simply blade-facing surface hereinafter), as seen in the axial direction of the drum 1, if the drum 1 were absent and a tangential line G tangential to the surface of the drum 1 at a point of intersection C where the cleaning blade 2 and the surface of the drum 1 join each other. Then, the initial contact angle θ is defined as the angle between the tangential line G and the virtual blade line F.

Also, to define the amount of bite d, assume a virtual point 2*b*' where a ridge portion 2*b* between the blade end surface 2*c* of the cleaning blade 2 and the blade-facing surface 2*a* (simply blade ridge portion 2*b* hereinafter), as seen in the axial direction of the drum 2, would be positioned if the drum 1 were absent. Then, the amount of bite d is defined as a distance d between a virtual tangential line H passing through the virtual point 2*b*' and parallel to the tangential line G and the tangential line G.

In order to implement the arrangement of the cleaning blade 2 described above, the blade ridge portion 2*b*, for example, is brought into contact with the surface of the drum 1 first. Subsequently, the cleaning blade 2 is moved toward the drum 1 in the direction normal to the surface of the drum 1 at the contact point in such a manner as not to vary the position of the cleaning blade 2 relative to the surface of the drum 1, as shown in FIG. 1.

As shown in FIG. 1, the rear end portion of the cleaning blade 2 opposite to the edge portion contacting the drum 1 is adhered to a metallic support plate or blade support member 3 affixed to a casing not shown. Generally, the cleaning blade 2 has width w1 of between 0.5 mm and 2.0 mm while the portion of the blade 2 not adhered to the support plate 3 (free end portion hereinafter) has length w2 of between 3.0 mm and 10.0 mm. Also, the cleaning blade 2 is formed of rubber or similar elastic member with hardness of between 65° and 80° in JIS (Japanese Industrial Standards)-A scale and is, in many cases, formed of polyurethane with a modulus of repulsive elasticity ranging from 20% to 60%.

Figure 2:
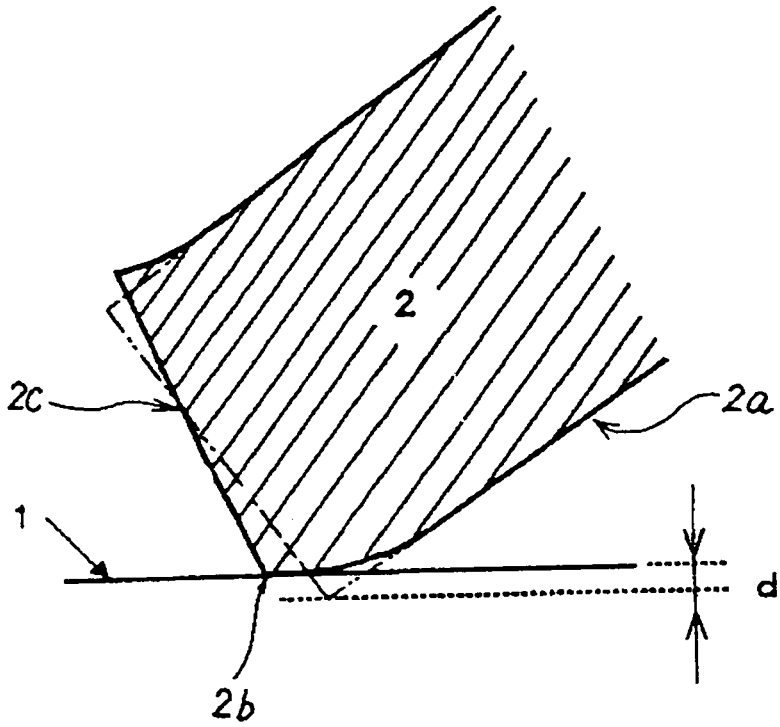
FIG. 2 shows how the edge portion of the cleaning blade deforms when the cleaning blade contacts the drum, which is held in a halt, with a certain amount of bite.

FIG. 2 is a section, as seen in the axial direction of the drum 1, showing the amount of deformation of the blade edge portion 2A to occur when the cleaning blade 2 is pressed against the drum 1, which is held stationary, by the amount of bite d. As shown, the surface of the blade edge portion 2A positioned at the downstream side contacts the surface of the drum 2.

Figure 3:
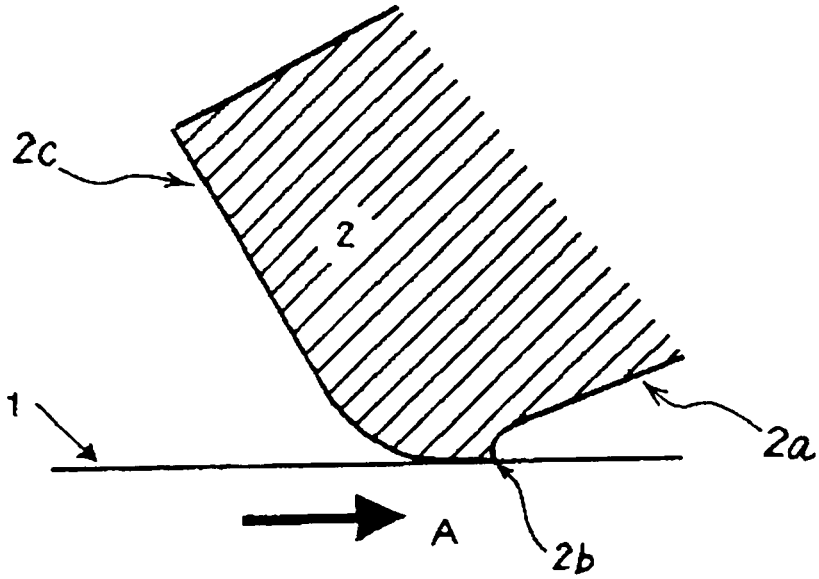
FIG. 3 shows the deformation of the blade edge portion to occur when the surface of the drum 1 is moved from the condition shown in FIG. 2.

FIG. 3 is a section similar to FIG. 2, showing how the blade edge portion 2A deforms when the surface of the drum 1 is moved in the direction A in the condition shown in FIG. 2. As shown, the blade-facing surface 2*a* of the cleaning blade 2, contacting the surface of the drum 1, is drawn in the direction A due to friction acting between it and the drum surface with the result that part of the blade-end surface 2*c* contacts the drum surface. This condition will be referred to as a stick state hereinafter.

While the surface of the drum 1 is in movement, the compression deformation around the blade ridge portion 2*b* is maintained at a point where a restoring force derived from the compression deformation and the dynamic frictional force acting at the contact portion remain in equilibrium. On the other hand, while the surface of the drum 1 is in a halt, the compression deformation is maintained by a static frictional force at the contact portion greater than the restoring force. It follows that the stick state is maintained constant if the dynamic frictional force of the contact portion does not vary during movement of the drum 1 and if the static frictional force of the contact portion is greater than the restoring force derived from the compression deformation around the blade ridge portion 2*b* in the static state.

In the stick state, the area over which the cleaning blade 2 and the surface of the drum 1 contact each other is smaller than in the condition shown in FIG. 2. Moreover, in the stick state, the portion around the blade ridge portion 2*b* is deformed by compression in the direction in which the surface of the drum 1 is moving, and the resulting restoring force acts in a direction in which the contact pressure between the cleaning blade 2 and the surface of the drum 2 increases. It is to be noted that such compression deformation does not occur in the condition shown in FIG. 2.

As stated above, in the stick state, the contact area of the cleaning blade with the surface of the drum 1 is small while the compression elasticity acts in the direction increasing the contact pressure between the cleaning blade 2 and the drum 1, so that the contact pressure is higher than in the condition of FIG. 2 and therefore allows a minimum of toner to slip by the cleaning blade 2. Therefore, to control the slip-by of toner, it is important to stably maintain the stick state during cleaning.

We experimentally observed how toner slipped through the contact portion between the cleaning blade 2 and the surface of the drum 1. For the experiment, the cleaning blade 2 was held in contact with the surface of a transparent surface-moving member having the same frictional characteristic as the surface of the drum 1. In this condition, the contact portion between the cleaning blade 2 and the surface-moving member was shot from the back by a camera in order to observe the slip-through of spherical toner. The experiment showed that spherical toner partly slipped through in the lengthwise direction of the cleaning blade 2 and that a stick-slip motion occurred at the portion where the spherical toner slipped through.

The stick-slip motion mentioned above refers to an occurrence that, assuming that the point of the blade ridge portion 2*b* is positioned in the stick state is zero or origin, the blade ridge portion 2*b* moved back and forth away from the origin by a distance of between 8 μm and 15 μm in a range upstream of the origin with respect to the direction of movement of the drum surface.

An extended series of experiments showed that the stick-slip motion stated above started occurring just after one or several spherical toner particles slipped through the contact portion between the cleaning blade 2 and the surface of the drum 1 held in the stick state.

Figure 4:
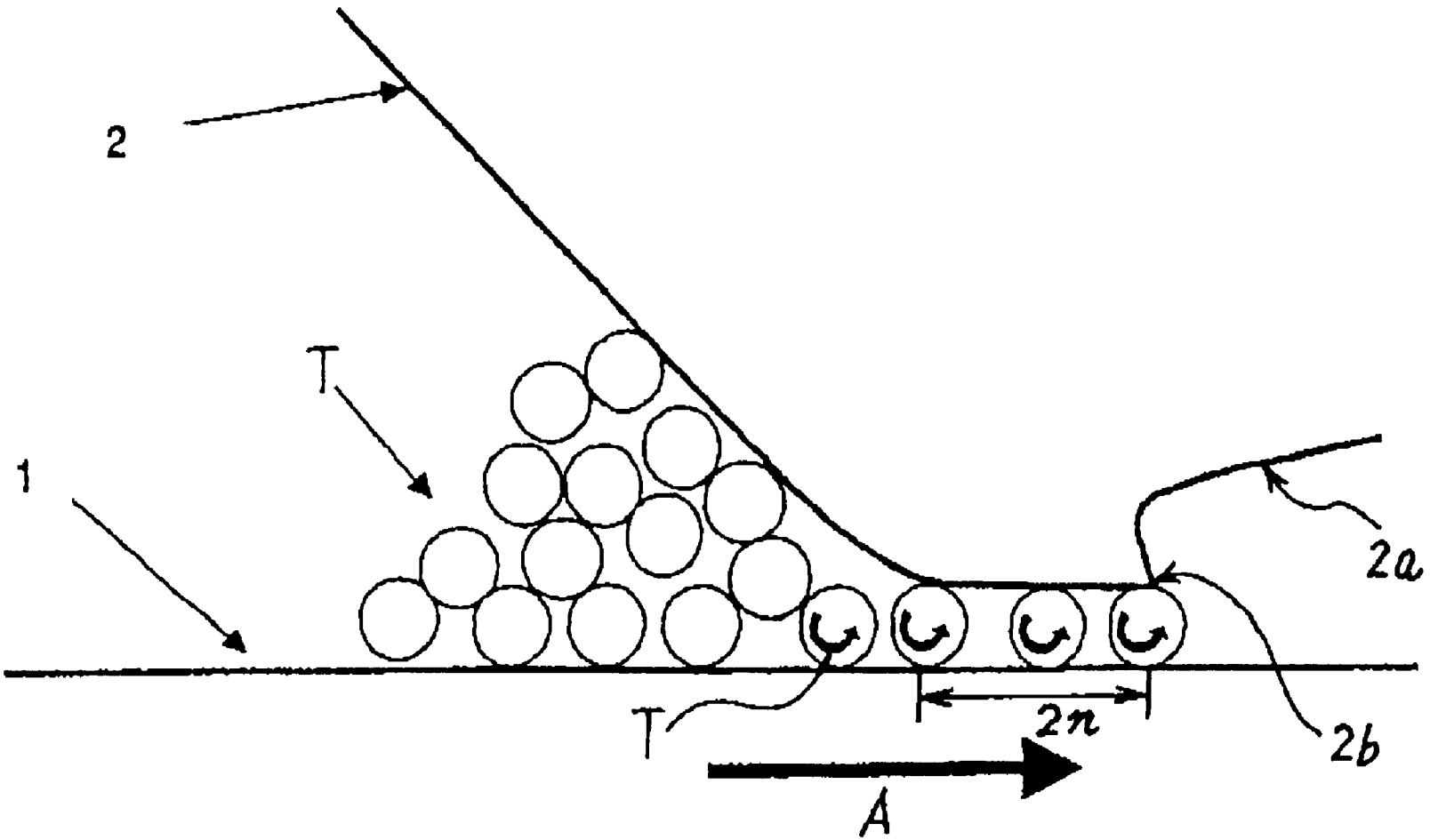
FIG. 4 shows a specific condition wherein spherical toner particles undesirably slip by the blade nip.

FIG. 4 is a sketch demonstrating how spherical toner particles T slip through the contact portion between the cleaning blade 2 and the surface of the drum 1 held in the stick state shown in FIG. 1. As shown, the spherical toner particles T conveyed by the surface of the drum 1 are stopped by a blade nip or blade contact portion 2*n* for a moment and then caused to start spinning by a frictional force acting at their contact portions with the drum 1. Subsequently, the toner particles T sink into and deform the cleaning blade 2 in the blade nip 2*n* with their spinning force and finally slip through the blade nip 2*n* while continuously spinning. More specifically, when the toner particles T get into the blade nip 2*n* in the condition wherein the cleaning blade 2 is deformed by compression, the toner particles T deform the cleaning blade 2 by pushing it upward. Let this deformation be referred to as sink deformation.

As stated above, the cleaning blade 2 in the stick state has its portion around the blade ridge portion 2*b* deformed by compression, as shown in FIG. 3. Just after one or more of the toner particles T have slipped through the contact portion, the resisting force, having been exerted from the surface of the drum 1 via the toner particles T against the restoring force derived from the sink deformation, stops acting. Consequently, the blade portion deformed by sink deformation tends to return to the shape before the deformation due to the above restoring force, causing the blade ridge portion 2*b* to move toward the upstream side in the direction of movement of the drum surface. As a result, as shown in FIG. 5, such a blade portion, indicated by a dashed circle I, is brought into the slip state with the blade-facing surface 2*a* contacting the drum surface.

Figure 5:
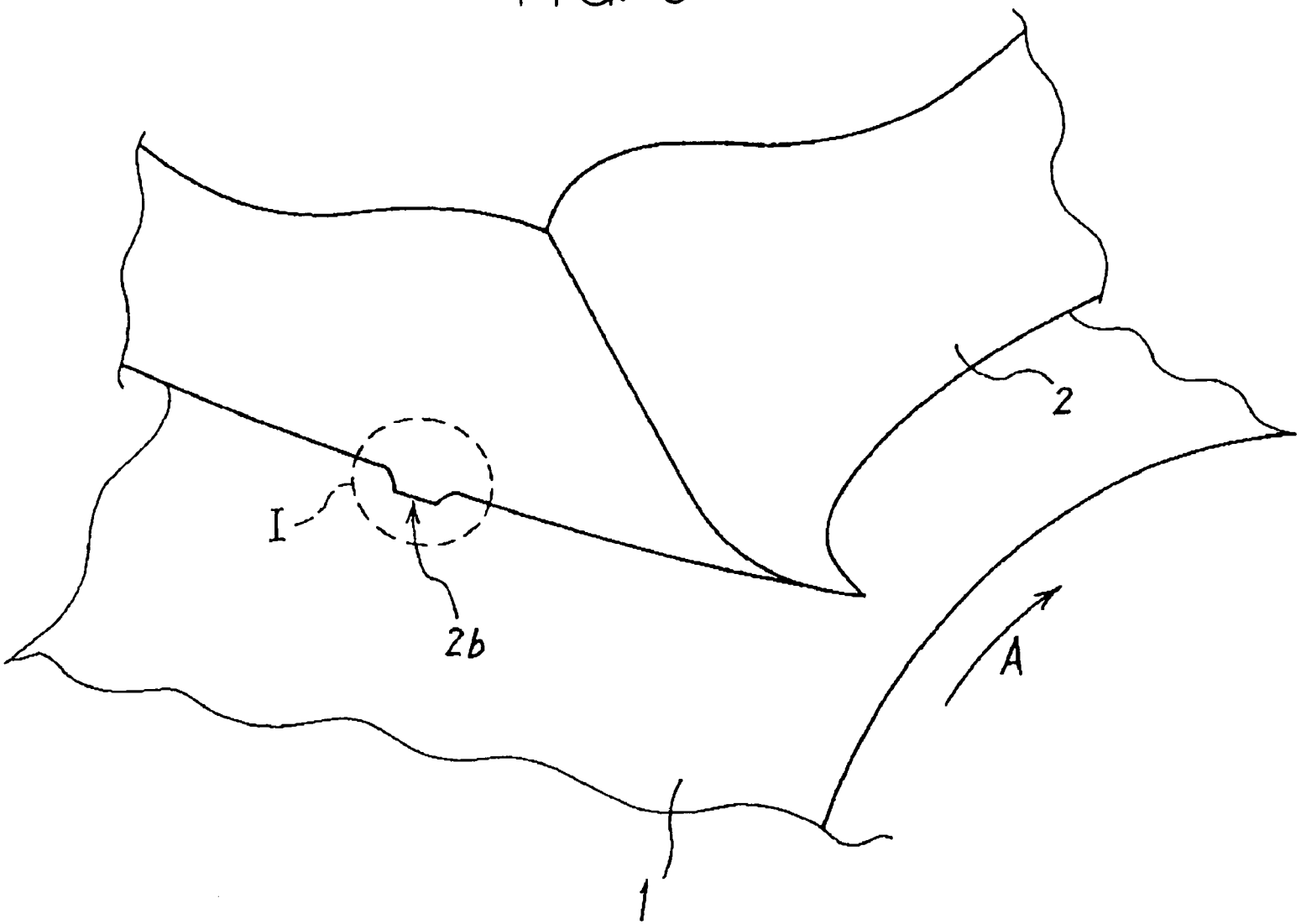
FIG. 5 is an enlarged isometric view showing the blade edge portion changed from a stick state to a slip state.

More specifically, as shown in FIG. 5, the portions of the cleaning blade 2 at both sides of the blade portion I in the lengthwise direction of the blade 2 are held in the stick state, so that the portion around the blade ridge portion 2*b* is sufficiently deformed by compression and causes a sufficient contact pressure to act because of the restoring force derived from the compression deformation. By contrast, in the blade portion I held in the stick state, the compression deformation around the blade ridge portion 2*b* and therefore the above restoring force is weak, preventing a sufficient contact pressure from acting in the contact portion between the blade portion I and the drum surface. As a result, the toner particles T slip by the blade portion I thus held in the slip state one by one.

Subsequently, frictional forces, acing between the above blade portion I and the surface of the drum 1 and toner particles sequentially slipping by, cause the blade ridge portion 2*b* to move toward the downstream side in the direction of movement of the drum surface and return to the stick state. However, the blade ridge portion 2*b*, so moving toward the stick state position, is obstructed by the toner grains sequentially slipping by and again moves toward the upstream side in the direction of movement of the drum surface due to the restoring force derived from the sink deformation, returning to the slip state. Such a stick-slip motion is repeated until the toner grains slipping by disappear. In the blade portion thus repeating the stick-slip motion, a great number of toner particles pass through the blade portion, resulting in defective cleaning.

The slip-by of toner particles decreases with an increase in the contact pressure acting between the cleaning blade 2 and the surface of the drum 1. It follows that if the contact pressure can be set extremely high, then it is possible to fully obviate the slip-by of the toner particles even when the toner particles are spherical. However, if the pressing force of the cleaning blade 2 acting on the drum 1 is made excessively high for the purpose of increasing the contact pressure, then the load acting on the surface movement of the drum 1 increases and makes it difficult to allow the surface of the drum 1 to stably move. Moreover, the cleaning blade 2 would shave off the surface of the drum 1 more than necessary and would thereby shorten the life of the drum 1.

Further, we found by experiments, including the above experiments, that a blade linear pressure capable of clearing spherical toner was dependent on the shape of an edge angle formed between the blade end face 2*c*, forming the ridge portion 2*b* contacting the drum 1, and the blade-facing surface 2*a*. More specifically, when a blade with an obtuse-angled edge and a blade with a right-angled or plain edge were compared with respect to cleaning ability under the same conditions, the former successfully effected cleaning with a lower blade linear pressure than the latter. Why such a difference occurred will be described hereinafter.

A blade with an obtuse-angled edge causes the portion of the cleaning blade around the blade ridge line 2*b* to deform less than a blade with a right-angled edge. In addition, when the cleaning blade 2, held in the position shown in FIG. 2, is drawn in the direction of movement of the drum surface to the stick state, the obtuse-angled edge reduces the movement of the blade ridge line 2*b* more than the right-angled edge for thereby reducing the width over which the blade-end surface 2*c* contacts the drum 1. Consequently, the nip width of the blade nip 2*n* over which the drum 1 and the cleaning blade 2 contact in the direction of movement of the drum surface decreases, so that the peak pressure to act on the drum 1 increases for a given blade linear pressure or pressing force.

However, although the cleaning blade 2 with an obtuse-angled edge initially, successfully cleared spherical toner, it brought about defective cleaning when repeatedly used over a long period of time for the following reason. When the edge angle of the cleaning blade 2 is obtuse, the angle between the blade-end surface 2*c* and the drum 1 becomes acute and allows toner to easily accumulate at the side upstream of the blade nip 2*n* in the direction of movement of the drum surface. This is because toner accumulates at the side upstream of the contact portion between the drum 1 and the cleaning blade 2 in the direction of movement of the drum surface with the result that the pressing force acting on the toner is scattered as if the contact width were increased. The pressing force thus scattered results in a lower peak pressure and therefore defective cleaning.

Preferred embodiments of the image forming apparatus in accordance with the present invention free from the problems discussed above will be described hereinafter.

First Embodiment

Figure 6:
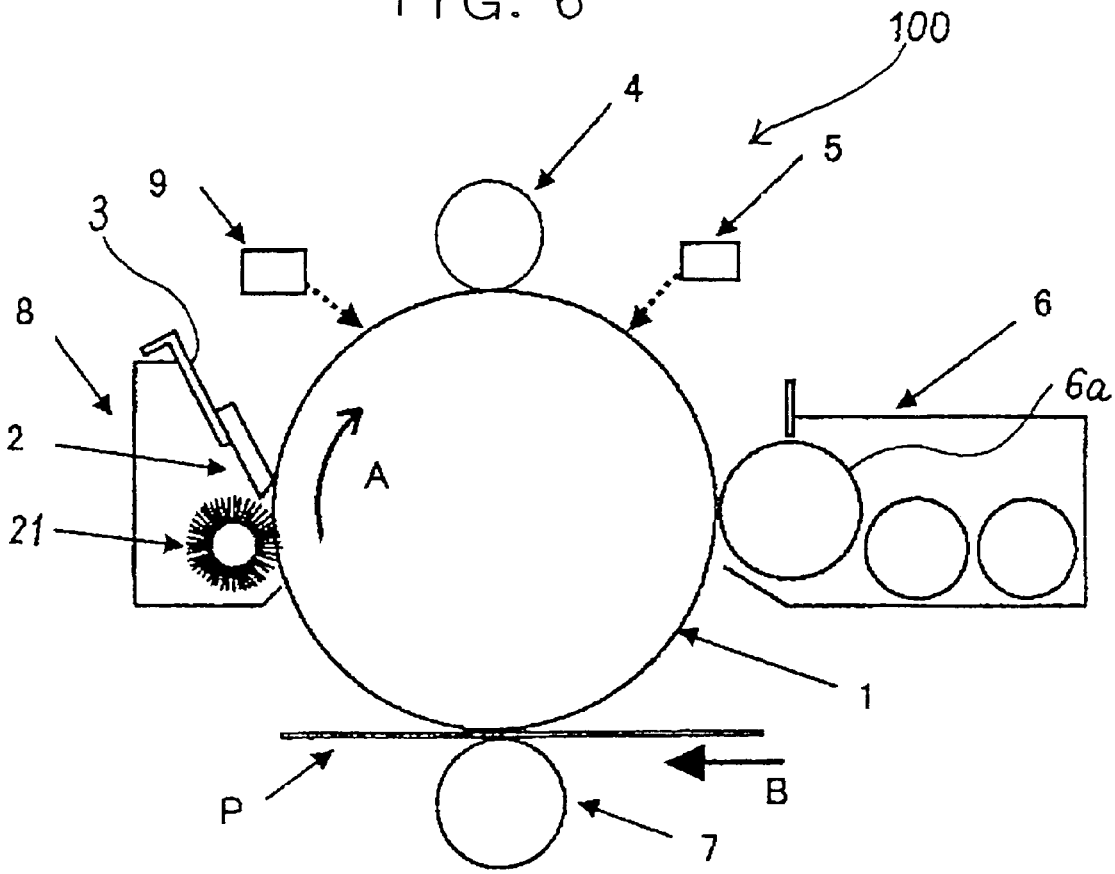
FIG. 6 is a view showing the general construction of a first embodiment of the image forming apparatus in accordance with the present invention and implemented as a printer.

Referring to FIG. 6, an image forming apparatus embodying the present invention is shown and implemented as a printer by way of example. As shown, the printer, generally 100, includes a photoconductive drum or toner image carrier 1 rotatable in a direction indicated by an arrow A in FIG. 6. The drum 1 is made up of a base formed of aluminum and a photoconductive layer formed on the base by use of an OPC (Organic PhotoConductor). Further, a surface layer formed on the drum 1 is formed of polycarbonate and has a coefficient of friction μ lying in the range of $0.3 \leqq \mu \leqq 0.6$ as measured by the Euler's belt method. Arranged around the drum 1 are a charger or charging means 4, an exposing unit or latent image forming means 5, a developing unit or means 6, an image transferring device or means 7, a cleaning unit or means 8 and a discharger or discharging means 9.

Further, a fixing unit or means, not shown, is located downstream of the image transferring device 7 in a direction B in which a paper sheet or similar recording medium P is conveyed (direction of sheet conveyance hereinafter) for fixing a toner image formed on the paper sheet P.

The charger 4 uniformly charges the surface of the drum 1. More specifically, the charger 4 includes a charging member contacting the surface of the drum 1 or spaced from the same by a small gap and applies a charge bias to the charging member in order to uniformly charge the surface of the drum 1 to desired polarity and desired potential. The charging member may be implemented by, but not limited to, an elastic charge roller or a scorotron charger made up of a wire electrode and a grid electrode.

The exposing unit 5 forms an electrostatic latent image on the surface of the drum 1 thus charged by the charger 4 in accordance with input image data. For example, the exposing unit 5 uses an LD (Laser Diode) or an LED (Light Emitting Diode) array as a light emitting device and scans the surface of the drum 1 with light modulated in accordance with image data for thereby forming a latent image.

The developing unit 6 develops the latent image formed on the drum 1 by depositing toner thereon. Mores specifically, the developing unit 6 includes a developing roller or developer carrier 6*a* in which a stationary magnet roller or magnetic field generating means is disposed. The developing roller 6*a* is rotated while carrying a developer deposited thereon, thereby feeding the developer to a developing zone where the roller 6*a* faces the drum 1.

In the illustrative embodiment, the developer is implemented as a toner and carrier mixture or two-ingredient type developer for magnet brush type development. That is, carrier particles, forming part of the developer, are caused to form bristles on the developing roller 6*a* in the developing zone by the magnetic force of the magnetic roller so as to form a magnet brush for development. The two-ingredient type developer may, of course, be replaced with a single-ingredient type developer, i.e., toner.

A bias power supply, not shown, applies a development bias to the developing roller 6*a* with the result that a difference occurs between the surface potential of the developing roller 6*a* and the potential of the latent image formed on the drum 1 in the developing zone. Such a potential difference forms an electric field for development and causes toner particles, forming the other part of the developer, to deposit on the latent image for thereby forming a corresponding toner image. It is to be noted that the configuration of the developing unit 6 described above is only illustrative.

The image transferring device 7 transfers the toner image thus formed on the drum 1 to the paper sheet P being conveyed toward the device 7 in a direction indicated by an arrow B in FIG. 6. More specifically, the image transferring unit 7 includes a transfer roller or similar transfer member pressed against the surface of the drum 1 by preselected pressure, forming an image transfer nip between the transfer member and the drum 1. When the paper sheet P is being nipped at the image transfer nip, a bias for image transfer opposite in polarity to the toner is applied from a bias power supply, not shown, to the transfer member for forming an electric field for image transfer, so that the toner image is transferred from the drum 1 to the paper sheet P. The transfer member may alternatively be implemented by an elastic transfer roller, an image transfer belt or a scorotron charger by way of example.

The paper sheet P thus carrying the toner image, i.e., a print is conveyed to the fixing unit, not shown, and then driven out of the printer body to a print tray not shown.

The cleaning unit or device 8 removes toner particles left on the surface of the drum 1 after the above image transfer and includes a cleaning blade 2 and a cleaning brush or cleaning member or toner removing means 21. The toner particles cleared by the cleaning blade 2 and cleaning brush 21 are dropped into the cleaning unit 8 and then conveyed to a waste toner bottle, not shown, by a conveyor, not shown, as waste toner. The waste toner stored in the waste toner bottle is collected by, e.g., a service person. If desired, the toner dropped into the cleaning unit 8 may be returned to, e.g., the developing unit 6 as recycled toner and again used for development.

The discharger 9 clears charges left on the surface of the drum 1 to thereby prepare the surface of the drum 1 for the next image formation. The discharger 9 may, of course be implemented by any suitable discharging system other than an optical discharging system using, e.g., an LED array.

Figure 7A:
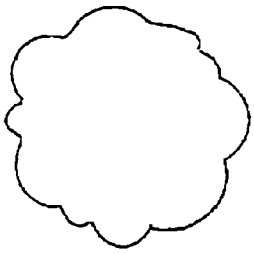
FIGS. 7A and 7B show a specific method of measuring circularity of a pulverized toner particle and that of a spherical toner particle.
Figure 7B:
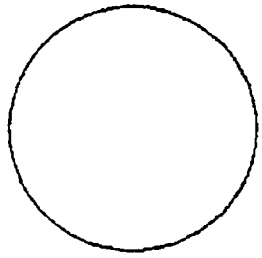

In the illustrative embodiment, use is made of toner having circularity of 0.98 or above in order to enhance image quality. Circularity refers to a mean degree of circularity measured by a flow type particle image analyzer FPIA-2000 (trade name) available from Sysmex Corporation. More specifically, for the measurement, after 100 ml to 150 ml of water free from solid impurities has been put in a container, 0.1 ml to 0.5 ml of surfactant, preferably alkylbenzen-sulfonate, is added to the water as a dispersant, and then 0.1 g to 0.5 g of sample (toner in this case) is added. The resulting suspension with the toner dispersed therein is dispersed for about 1 minute to 3 minutes in an ultrasonic dispersing device until the density of the dispersion reaches the range of 3,000/μl to 10,000/μl. Subsequently, the mixture thus prepared is set in the analyzer mentioned above in order to measure the shapes and distribution of toner particles. Thereafter, a ratio of C2/C1 is determined where C1 denotes the circumferential length of the projected shape of an actual toner particle shown in FIG. 7A while C2 denotes the circumferential length of a true circle shown in FIG. 7B and having the same projection area S as the toner particle of FIG. 7A. The mean value of such ratios C2/C1 is used as circularity.

Spherical toner has customarily been produced by, e.g., heating pulverized toner particles having irregular shapes or by polymerization. A conventional cleaning blade configured to remove pulverized toner from the surface of the drum 1 cannot sufficiently clear spherical toner, resulting in defective cleaning.

Our analysis showed that the stick-slip motion of the blade ridge portion ascribable to spherical toner particles, which slip into the blade nip 2*n* while spinning themselves, did not occur at all at the position where the cleaning blade 2, FIG. 6, removed spherical toner. On the other hand, in the blade nip 2*n* between the cleaning blade 2 and the drum 1 where defective cleaning occurred, the blade ridge portion 2*b*, in many cases, was found to move in the stick-slip motion.

It will therefore be seen that if the stick-slip motion is obviated, then the slip-by of a great number of spherical toner particles and therefore defective cleaning can, in many cases, be obviated. Further experiments, conducted with attention paid to the above point, indicated that, among various cleaning conditions, a vertical pressure drag or blade linear pressure applied from the cleaning blade 2 to the drum 1 is closely related to the stick-slip motion. It was also found that the amount of toner accumulated at the side of the drum 1 upstream of the blade nip 2*n* in the direction of movement of the drum 1 has noticeable influence on the cleaning ability.

Figure 8:
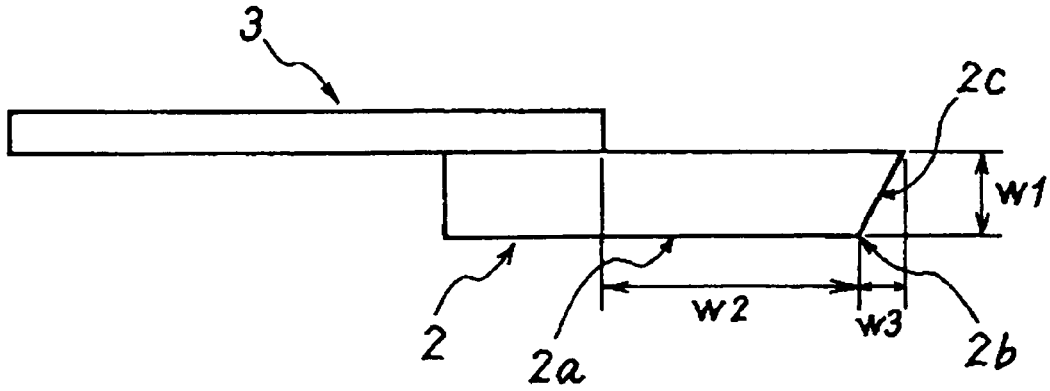
FIG. 8 is a section showing a cleaning blade and a metallic support included in the illustrative embodiment.

FIG. 8 is a section showing the cleaning blade 2 and metallic support 3 supporting it. As shown, the cleaning blade 2 is machined such that two surfaces forming a ridge line that contacts the drum 1 adjoin each other at an obtuse angle. More specifically, the edge portion of the cleaning blade 2, having width of w1, is cut by width of w1×w3. In FIG. 8, w2 denotes the length of the free-length blade portion between the end of the adhered portion of the cleaning blade 2 adhered to the support plate 3 and the blade ridge portion 2*b*.

Figure 9:
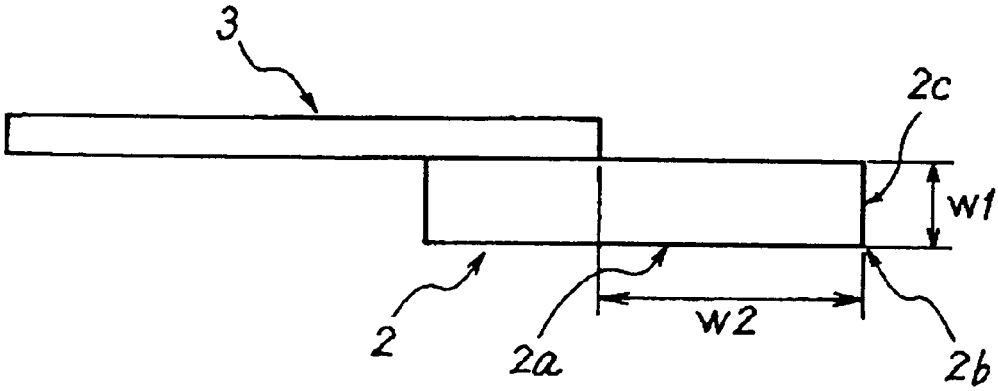
FIG. 9 is a section showing a cleaning blade and a metallic support with a conventional configuration.

FIG. 9 is a section showing a conventional cleaning blade 2 with a plain or non-machined edge and a metallic support plate 3 supporting it. As shown, the portion of the cleaning blade 2 expected to contact the drum 1 is provided with an edge angle of 90° in order to enhance ridge accuracy and therefore uniform contact thereof with the drum 1. In the illustrative embodiment, the edge angle is obtuse and selected from the range of 95° to 120° in order to further enhance the ridge accuracy.

Experiments were conducted with the cleaning blade 2 having the obtuse-angle ridge and cleaning blade 2 having the plain ridge in order to determine the pressure exerted by the cleaning blade on the drum 1 when the blade was pushed into the drum 1 by a certain amount (pressure for a unit length of the blade; referred to as a cleaning linear pressure hereinafter) and the cleaning ability at the initial stage. For the experiments, use was made of spherical toner with circularity of 0.98 or above while each cleaning blade 2 was sized, according to FIGS. 8 and 9, w1=3.6 mm, w2=7.2 mm and w3=1.8 mm. Further, the drum 1 had a diameter of as small as 30 mm. Experiments were conducted with the spherical toner being deposited on the entire surface of the drum 1 by the developing unit.

Figure 10:
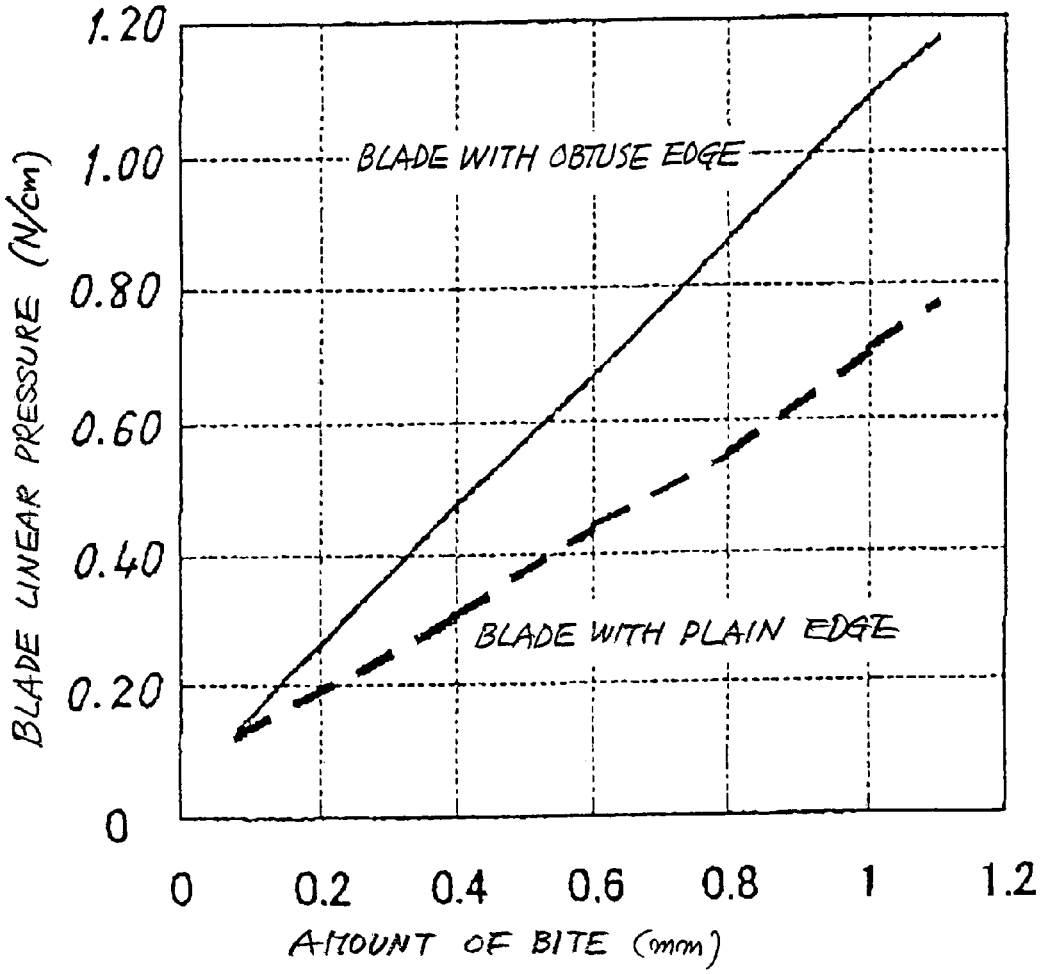
FIG. 10 is a graph showing a relation between the amount of bite and a blade linear velocity.

FIG. 10 is a graph comparing the cleaning blade 2 with the obtuse-angle edge and the conventional cleaning blade 2 with the plain or right-angled edge with respect to the above-stated blade linear pressure or vertical pressure drag and the amount of push or bite of the blade 2 into the drum 1. As shown, the obtuse edge increases the rate of increase of the blade linear pressure for the amount of bite more than the plain edge.

Figure 11:
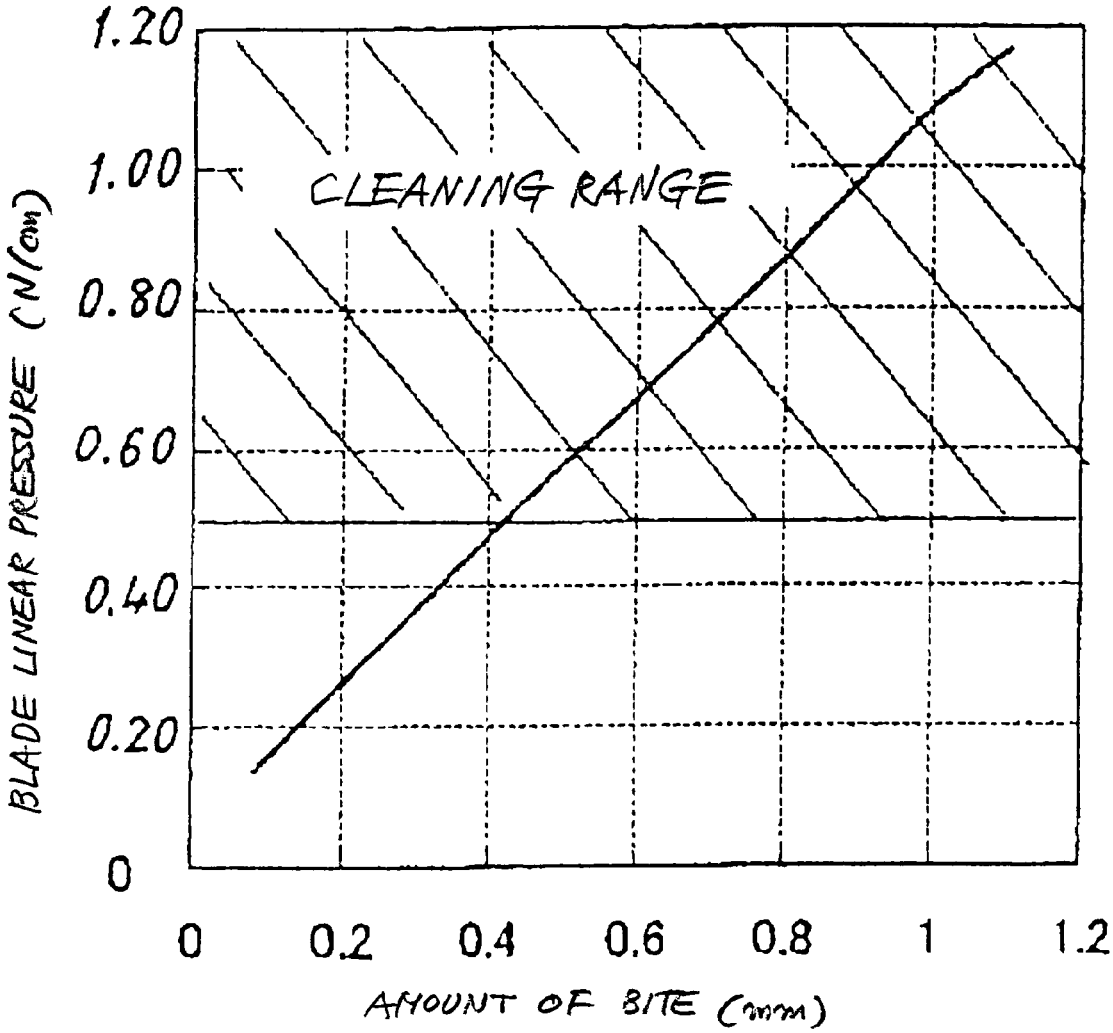
FIG. 11 is a graph showing a range of linear pressure in which a blade with an obtuse-angled edge can clear spherical toner particles.
Figure 12:
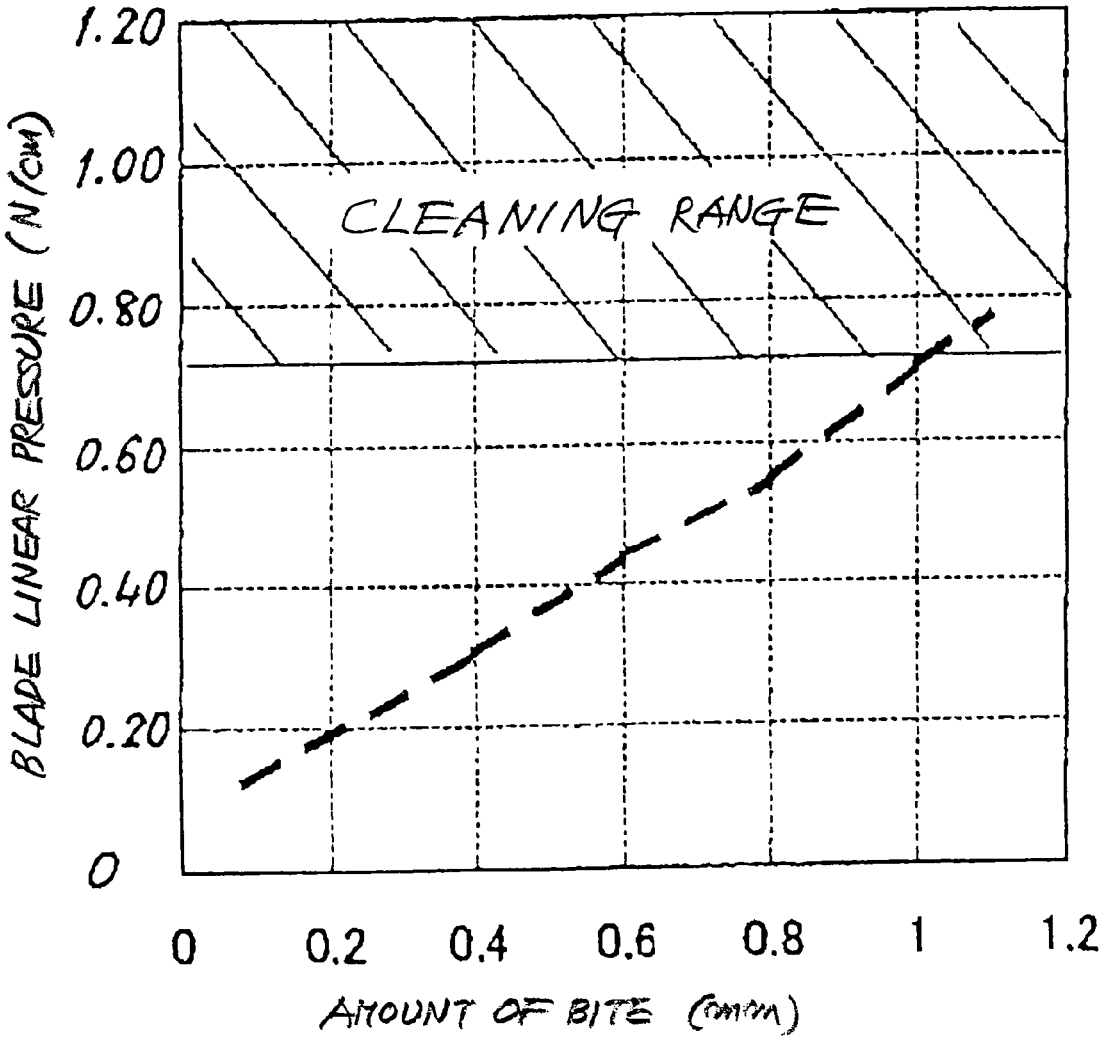
FIG. 12 is a graph showing a range of linear pressure in which a blade with a right-angled or plain edge can clear spherical toner particles.

FIG. 11 is a graph showing the range of linear pressure in which the cleaning blade with the obtuse-angled edge can clear spherical toner while FIG. 12 is a graph showing the range of linear pressure in which the cleaning blade with the right-angled edge can clear spherical toner. The experimental results shown in FIGS. 11 and 12 are initial evaluation results not giving consideration to aging, environmental variation or the like.

As shown in FIG. 11, the cleaning blade with the obtuse-angled edge was capable of clearing spherical toner when the blade linear pressure was 0.5 N/cm or above. By contrast, as shown in FIG. 12, the cleaning blade with the right-angled or plain edge failed to clear spherical until the blade linear pressure was increased to 0.75 N/cm or above. Such a difference between the two kinds of cleaning blades is accounted for by the following.

Figure 13:
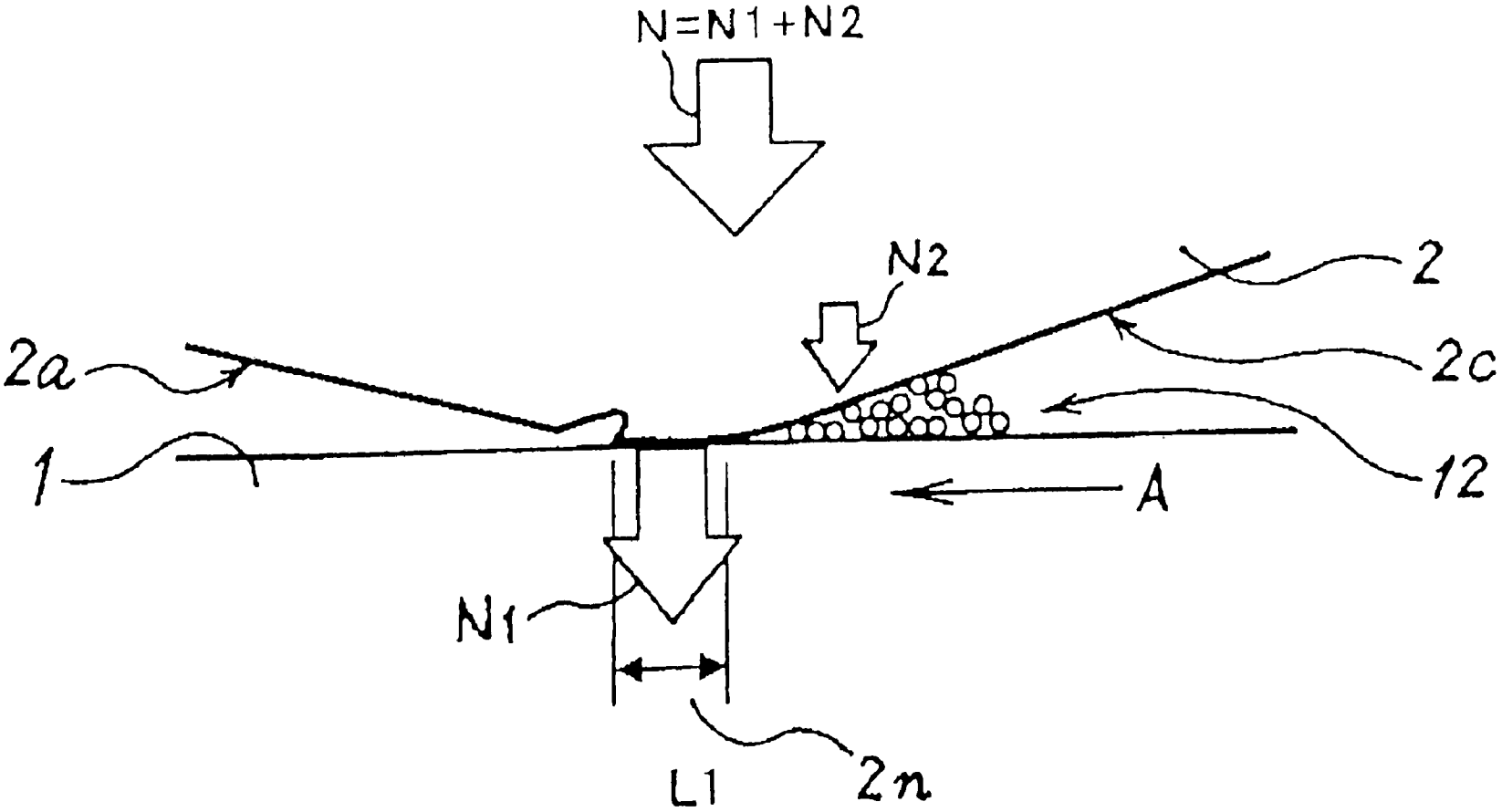
FIG. 13 is a view showing a relation between drag forces exerted by the cleaning blade with the obtuse-angled edge on the drum.
Figure 14:
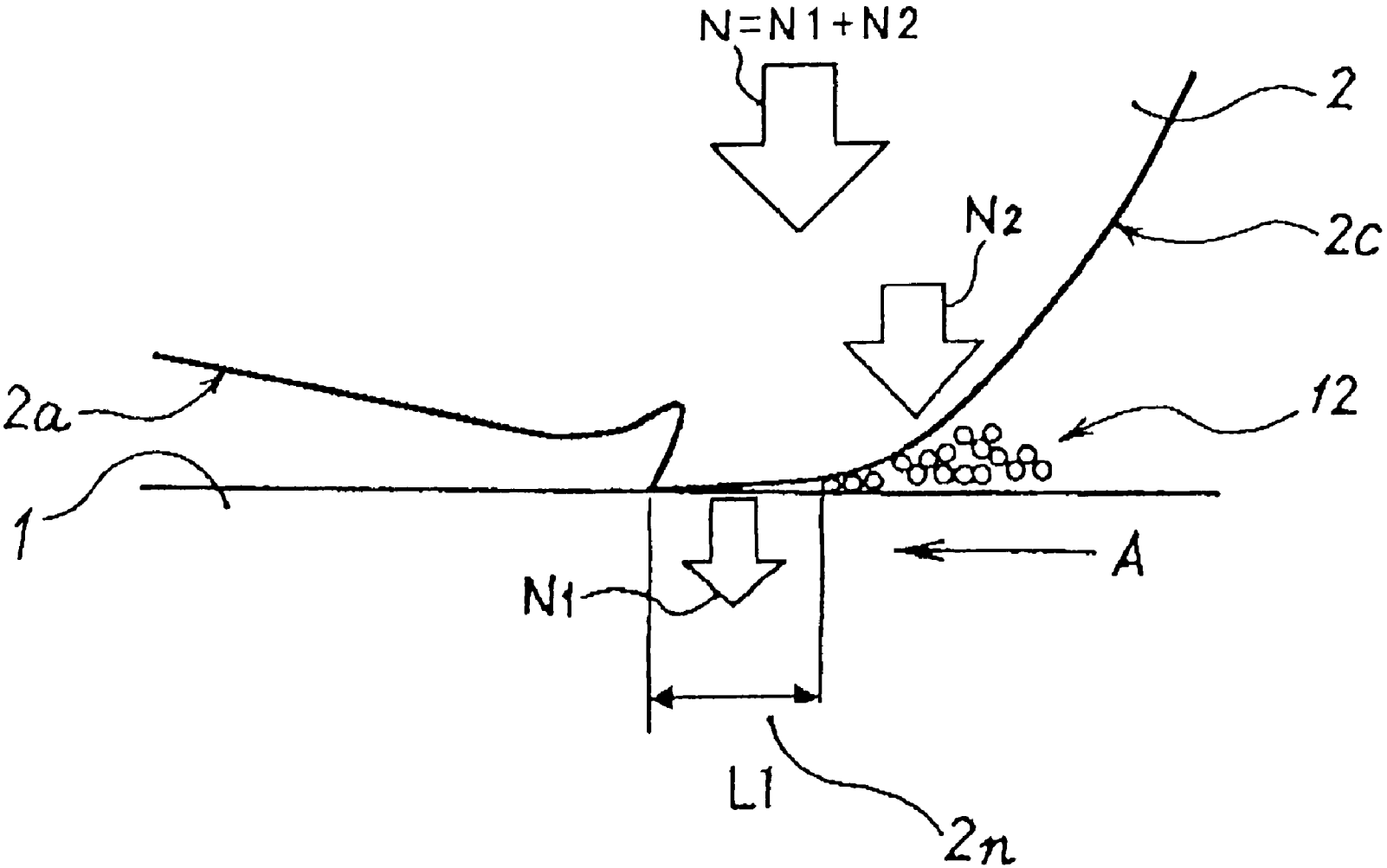
FIG. 14 is a view similar to FIG. 13, showing a relation between drag forces exerted by the cleaning blade with the right-angled edge on the drum.

FIG. 13 shows a vertical drag force acting on the drum 1 when the cleaning blade 2 with the obtuse-angled edge is in operation while FIG. 14 shows a vertical drag force acting on the drum 1 when the conventional cleaning blade 2 with the right-angled edge is in operation. As shown, toner particles 12 accumulate in a wedge-shaped space between the blade edge 2*c* and the drum 1 at the side upstream of the blade nip 2*n* in the direction of rotation of the drum 2.

There are shown in FIGS. 13 and 14 a vertical drag force or blade linear pressure N, a drag force directly exerted by the cleaning blade 2 on the surface of the drum 1 at the blade nip 2*n*, and a drag force exerted by the blade edge 2*c* on the surface of the drum 1 via the toner particles 12 accumulated. Because the following description concentrates on the initial condition of use of the cleaning blade 2, assume that the number of toner particles 12 is small, and therefore the influence of the drag force N2 exerted on the drum 1 via the toner particles 12 is neglected.

Friction acts between the cleaning blade 2 and the drum 1 at their contact position, so that the blade 2 is drawn in the direction of movement of the drum 1. As shown in FIG. 14, when the conventional cleaning blade 2 is used, the blade noticeably deforms with the result that a width L1 over which the drum 1 and blade 2 contact each other, i.e., the width of the blade nip 2*n* increases. Consequently, the peak pressure of the drag force N1 acting on the drum 1 decreases and causes the blade edge to move in the stick-slip motion, further increasing the blade linear pressure N necessary for stopping the toner particles 12.

On the other hand, as shown in FIG. 13, the obtuse-angled edge of the cleaning blade 2 is dragged little by the friction acting between the blade 2 and the drum 1, so that the width L1 of the blade nip 2*n* decreases and, in turn, increases the peak pressure of the drag force N1 exerted by the blade 2 on the drum 1. This prevents the cleaning blade 2 from moving in the stick-slip motion and allows the blade 2 to stop the toner particles 12.

As stated above, for a given blade linear pressure N, the peak pressure of the cleaning blade 2 influences the cleaning ability when the drum 1 is moving while deforming the blade 2. It follows that the cleaning blade 2 with the obtuse-angled edge, which deforms little, can control a decrease in the peak pressure acting on the drum 1 and consequently clear the spherical toner particles without any stick-slip motion.

Further, it is known that the stick-slip motion of the cleaning blade 2 can be reduced if the blade 2 is formed of an adequate material. For example, if the cleaning blade 2 is provided with high hardness, then it is possible to reduce the deformation of the blade 2 ascribable to the collision of the spherical toner grains and therefore an irregular distribution of the drag force of the blade 2 acting on the drum 1, thereby stabilizing the contact condition of the blade 2 with the drum 1.

We experimentally found that even when the stick-slip motion did not occur, defective cleaning was sometimes brought about in dependence on the material of the blade 2, as will be described hereinafter. As shown in FIG. 4, the spherical toner particles T stopped at the blade nip 2*n* again push away the portion of the cleaning blade 2 contacting it while biting into the blade 2 and finally slip through the contact portion between the blade 2 held in the stick state and the drum 1. At this instant, if the material of the cleaning blade 2 has a great modulus of repulsive intensity, then the portion of the cleaning blade 2 deformed by the toner particles restore at high speed with the result that the blade ridge 2*b*, corresponding to the above portion, contacts the drum 1 at high speed due to the restoration. Consequently, the blade ridge portion 2*b* moves along the surface of the drum 1 until it falls down in the slip state.

The portion of the cleaning blade 2 thus changed from the stick state to the slip state reaches the condition described with reference to FIG. 5, resulting in the stick-slip motion. This is presumably because the amount of kinetic energy of the blade ridge 2*b* is greater than the amount of energy lost by friction due to the contact of the blade ridge 2*b* with the drum 1.

On the other hand, if the modulus of repulsive elasticity of the material, forming the cleaning blade 2, is small, then the portion of the blade 2 deformed by the toner particles slipped by restore at low speed, so that the portion of the blade ridge 2*b* corresponding to the above portion does not contact the drum 1 with a great force, i.e., the amount of kinetic energy of the blade ridge 2*b* is greater than the amount of energy lost by friction due to the contact of the blade ridge 2*b* with the drum 1. Consequently, the blade ridge portion 2*b* returns to the stick state due to friction acting between it and the drum 1 before reaching the slip state. This obviates the stick-slip motion for thereby preventing a great amount of toner from slipping through at a time. In this manner, when the cleaning blade 2 is formed of a material having a small modulus of repulsive elasticity, it is possible to free the blade 2 from the stick-slip motion just after the slip-by of the toner particles.

However, even if the modulus of repulsive elasticity of the cleaning blade 2 is small enough to obviate the stick-slip motion, defective cleaning occurs if the hardness of the blade 2 is low. When the cleaning blade 2 has a mall modulus of repulsive elasticity and low hardness, the portion of the blade where the toner particles T have just slipped by greatly deforms due to deformation and therefore restore at low speed with the result that the next toner particle T slips by the above portion during the restoration. If the toner particle T passes by during the restoration, it obstructs the restoration and causes another toner particle T to pass by. As a result, a great amount of toner particles T slip by the portion of the cleaning blade which a single toner particle T slipped by at a time, bringing about defective cleaning.

Should the cleaning blade 2 be provided with high hardness, due to the straightness of the blade 2 or that of the drum 1 itself, contact between the blade 2 and the drum 2 would become irregular and bring about irregular cleaning although the blade linear pressure might be high.

More specifically, when the hardness of the cleaning blade 2 is 80° or above, the blade member itself creeps with the result that the blade linear pressure or elasticity is initially high, but decreases with the elapse of time. On the other hand, when the cleaning blade 2 is formed of an elastic material having low hardness, the blade linear pressure varies little relative to the amount of bite, the blade 2 must bite into the drum 1 deeply enough to implement the blade linear pressure necessary for cleaning. If the amount of bite is increased despite the low hardness, the contact area of the cleaning blade 2 with the drum 1 increases and makes the pressure distribution flat, i.e., lowers the peak pressure.

In light of the above, in the illustrative embodiment, the cleaning blade 2 is provided with hardness of between 65° and 80° in JIS-A scale for implementing an adequate cleaning ability.

As for the modulus of repulsive elasticity, if it is small, then it is possible to lower the restoring force of the cleaning blade 2 against the deformation ascribable to the collision of the toner particle for thereby stabilizing the contact of the blade 2 with the drum 1. Repulsive elasticity allows, e.g., the blade ridge portion 2*b* to repulse the toner particle contacting it when the cleaning blade 2 clears the toner. When pulverized toner or similar non-spherical toner is used, it has been customary to increase the repulsive elasticity for the purpose of repulsing the toner and thereby enhancing the cleaning ability. However, it has recently been reported that when spherical toner is used, the toner gets under the cleaning blade 2 at the blade nip 2*n* before being repulsed by the blade 2, resulting in limited cleaning ability. It is to be noted that to reduce the repulsive elasticity of the cleaning blade 2, use is often made of a polyurethane component or similar hard segment.

Figure 15:
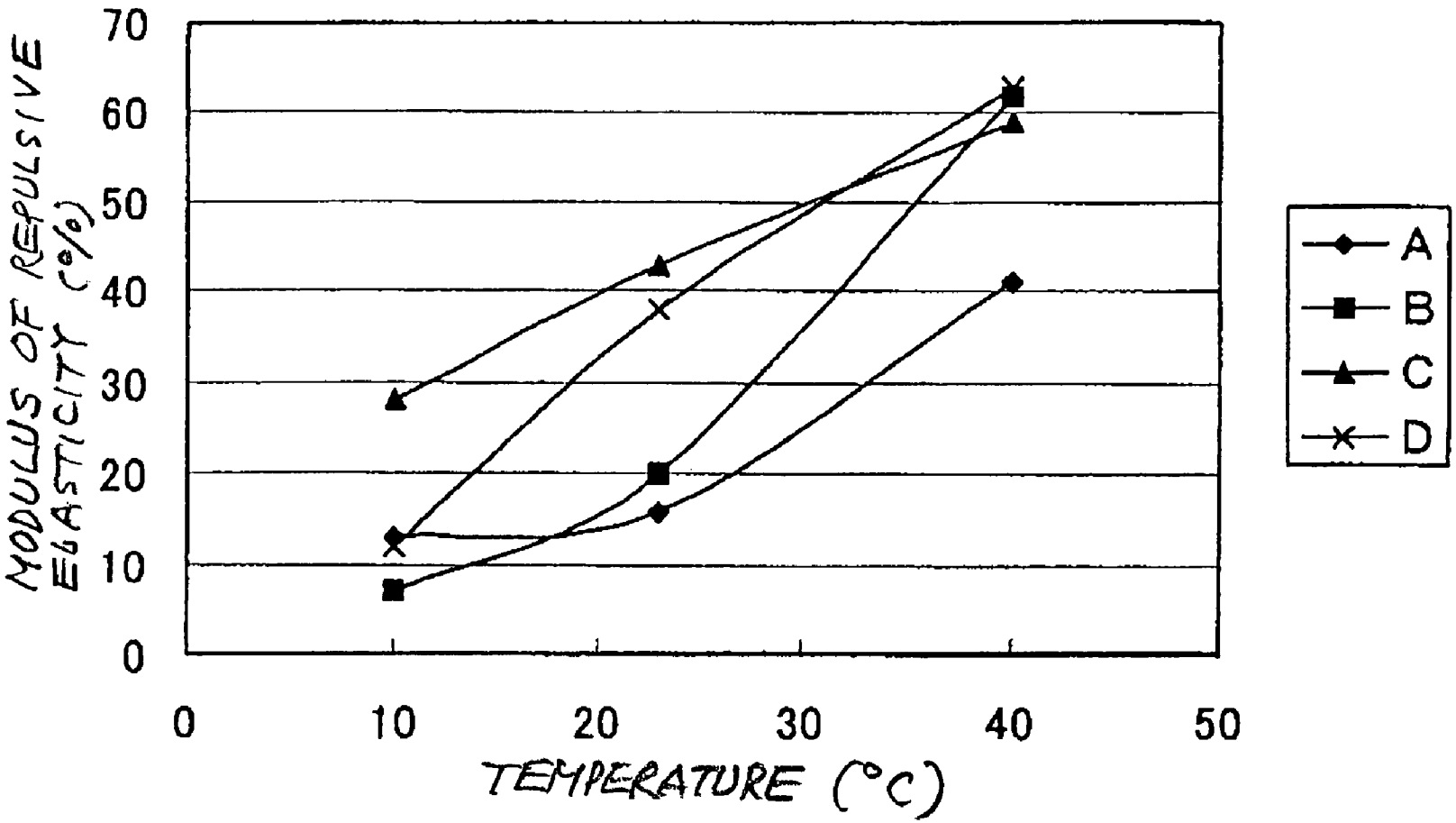
FIG. 15 is a graph comparing four kinds of cleaning blades with respect to a relation between the modulus of repulsive resiliency and temperature.

It will thus be seen that a cleaning blade with low repulsion is essential for a high linear pressure. FIG. 15 shows how the modulus of repulsive elasticity varies with respect to temperature. As shown, the modulus of repulsive elasticity generally tends to increase with the elevation of temperature. However, paying attention to a product C having a relatively great modulus of elasticity at 10° C., the modulus increases at 40° C., but the ratio of variation itself is only about 200%. By contrast, as for a product B having a small modulus of repulsive intensity at low temperature, the modulus increases at high temperature to such a degree that the ratio of variation is as great as 600%. Stable cleaning ability was achieved with a product A whose modulus of repulsive intensity was 30% or below at normal temperature, but the ratio of variation was 350% or below.

More specifically, experiments showed that a cleaning blade 2 with a modulus of repulsive elasticity of 30% or below at 23° C. and with a ratio of variation of 350% or below at temperature between 10° C. and 40° C. could effectively clear spherical toner. In this manner, the cleaning blade 2 can successfully clear spherical toner if provided with an adequate edge configuration and formed of an adequate material.

Figure 16:
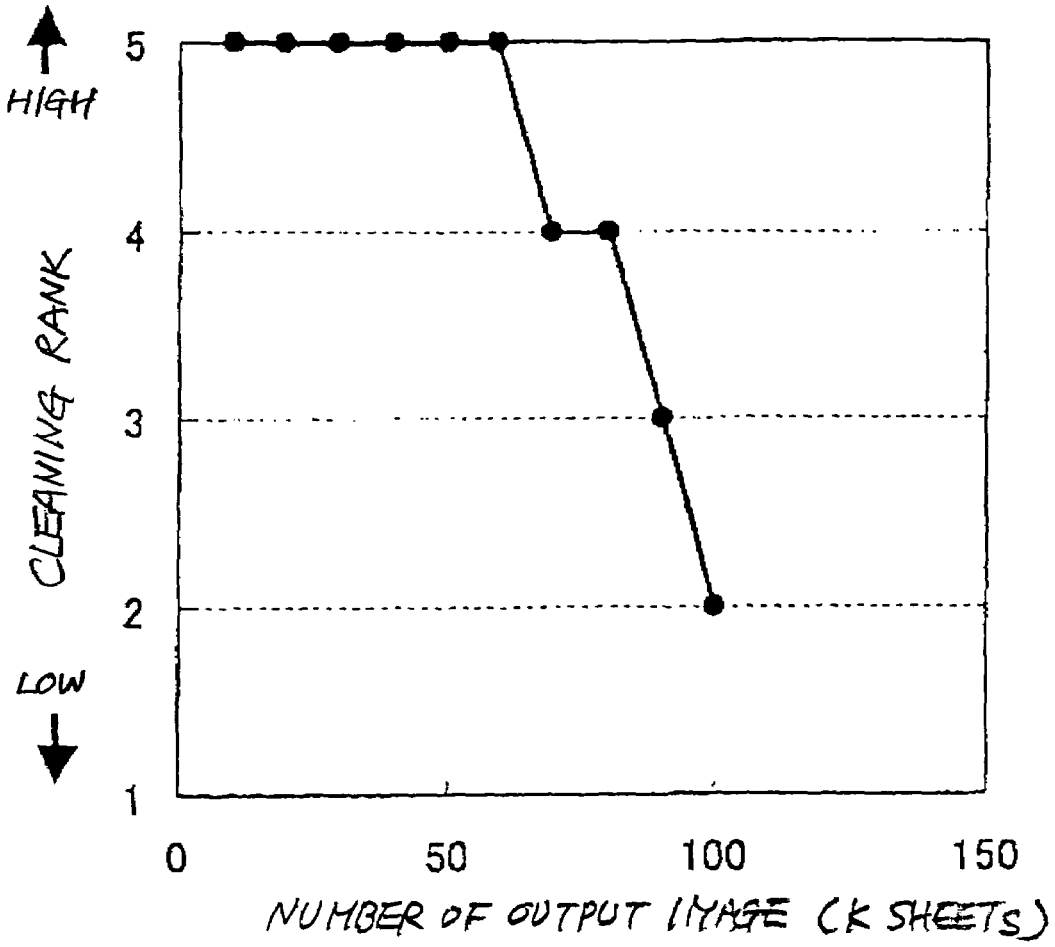
FIG. 16 is a graph showing the results of durability tests conducted with the cleaning blade with the obtuse-angled edge.

A relation between the cleaning ability and aging, as distinguished from the initial evaluation described above, will be described hereinafter. FIG. 16 is a graph showing the results of durability tests conducted to determine how the cleaning ability of the cleaning blade 2 having the obtuse edge angle varies due to aging. In FIG. 16, the ordinate and abscissa indicate the cleaning ability and the number of images produced, respectively. For the durability tests, a digital printer imagio NEO 352 available from RICOH was used to form a horizontal stripe image with an image area of 5% on an A4, landscape paper sheet while toner left on the drum 1 after cleaning was observed by eye for evaluating the cleaning ability in ranks. The higher the rank, the higher the cleaning ability; rank 5 indicates perfect cleaning while rank 1 indicates defective cleaning occurred over the entire surface.

As FIG. 16 indicates, the cleaning blade 2 with the obtuse edge angle desirably cleared spherical toner at the initial stage, but the cleaning ability thereof sharply decreased at a certain point. This is accounted for by the following experimental results.

Figure 17:
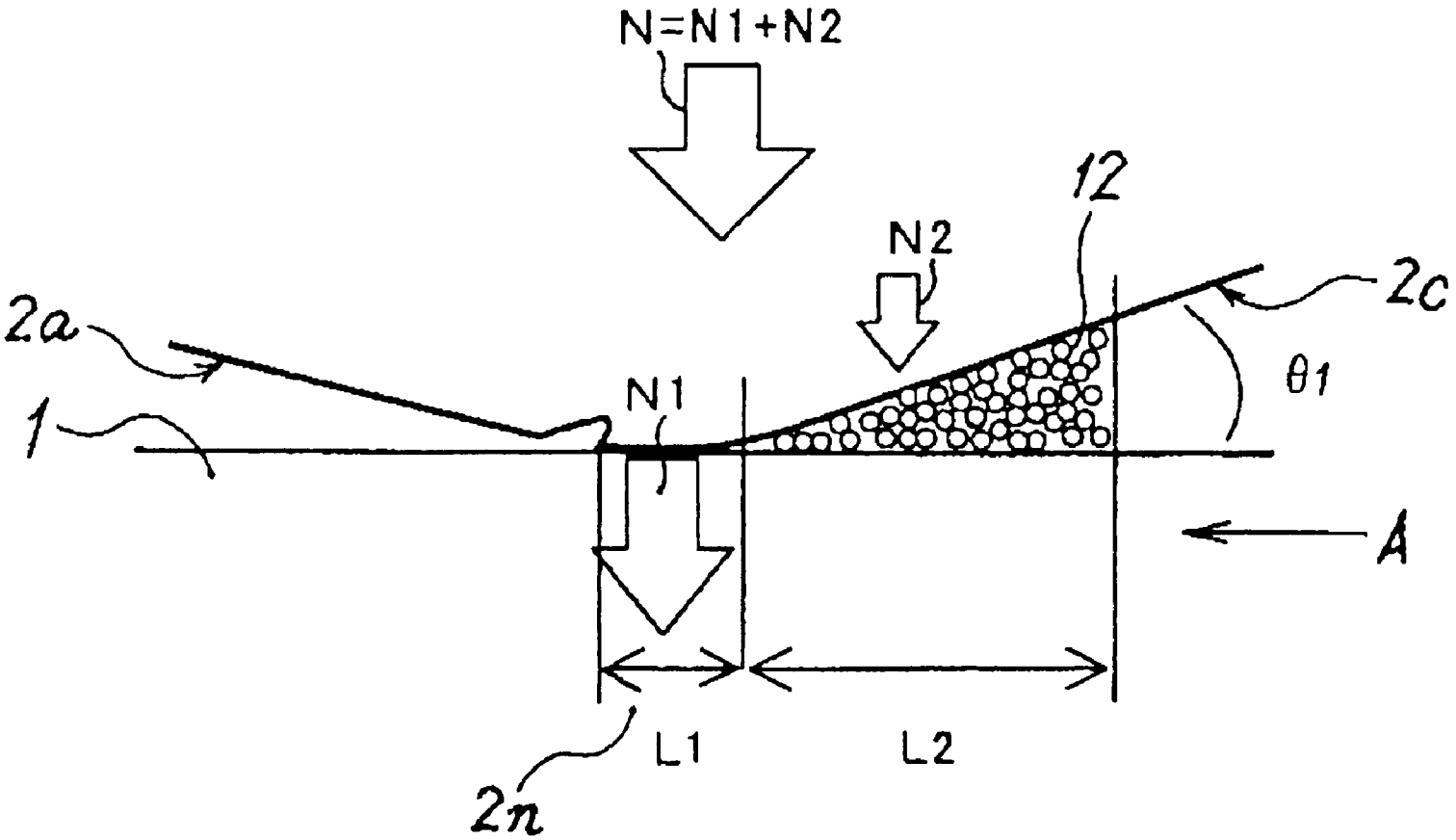
FIG. 17 is a section showing a specific condition wherein spherical toner particles accumulate when the cleaning blade with the obtuse-angled edge is used.
Figure 18:
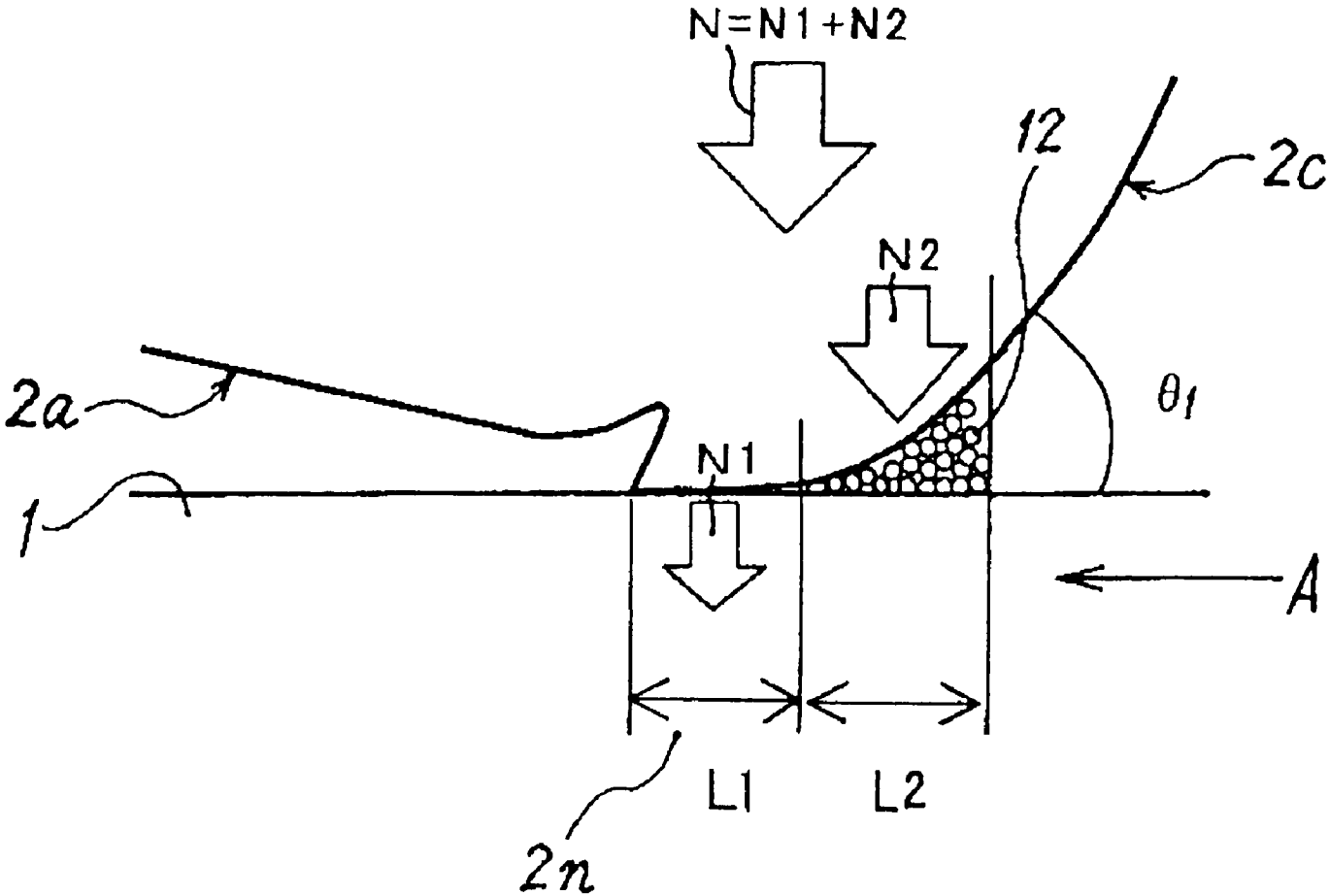
FIG. 18 is a section similar to FIG. 17, showing a specific condition wherein spherical toner particles accumulate when the cleaning blade with the right-angled edge is used.

FIG. 17 is a section showing the contact portion between the cleaning blade 2 and the drum 1 where spherical toners are accumulated when the cleaning blade 2 with the obtuse-angled edge is used. FIG. 18 is a view similar to FIG. 17 showing spherical toners accumulated when the cleaning blade 2 with the plain edge is used. There are shown in FIGS. 17 and 18 a blade linear pressure N, a drag force N1 directly exerted by the cleaning blade 2 on the drum 1 at the blade nip 2*n*, and a drag force N2 exerted by the blade 2 on the drum 1 via the accumulated toner particles. Also shown in FIGS. 17 and 18 is an angle or cleaning angle θ1 formed between the blade-end face 2*c* and the drum 1.

The cleaning angle 1 available with the cleaning blade 2 with the obtuse-angled edge is smaller than one available with the cleaning blade 2 with the plain edge, forming a wedge-shaped space having a more acute angle and therefore a greater toner width L2. If the toner particles 12 continuously accumulate in the wedge-shaped space upstream of the blade nip 2*n* in the direction of movement of the drum 1, then the area of the toner particles sandwiched between the cleaning blade 2 and the drum 1 increases. This undesirably scatters the blade linear pressure or pressing force N into the drag force N2 to thereby lower the drag force N1 essential for stopping the toner particles.

In light of the above, in the illustrative embodiment, the cleaning brush 21, formed of a metallic core and a conductive brush, is used as means for preventing toner from accumulating. The cleaning brush 21 is configured to remove the spherical toner particles 12 accumulated in the wedge-shaped space upstream of the blade nip 2*n* in the direction of movement of the drum 1 while evenly scattering the toner particles thus removed on the surface of the drum 1.

Figure 19A:
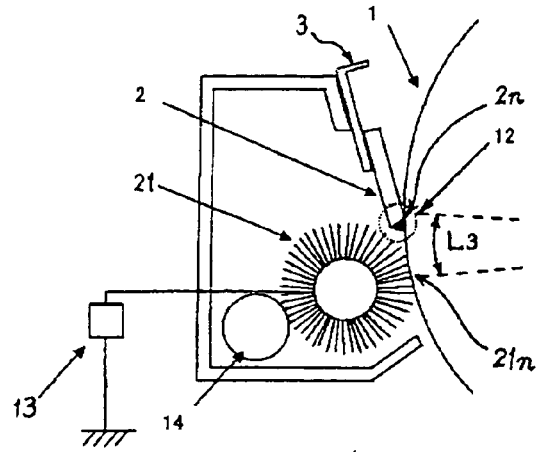
FIGS. 19A through 19D demonstrate a series of movements of the drum and cleaning brush occurring in a cleaning mode unique to the illustrative embodiment.

More specifically, FIGS. 19A through 19D demonstrate a series of movements of the cleaning brush 21 performed in an accumulated toner removing mode, as stated above. FIG. 19A shows a condition wherein the drum 1 is held stationary after the cleaning brush 21 and cleaning blade 2 with the obtuse edge angle have removed the spherical toner particles from the drum 1. Let the position were the cleaning brush 21 and drum 1 contact each other in FIG. 19A be referred to as a brush nip 21*n*. More specifically, in FIG. 19A, a certain amount of accumulated toner particles 12 exist in the wedge-shaped space upstream of the blade nip 2*n* in the direction of movement of the drum 1.

When the amount of accumulated toner particles in the above space exceeds a preselected value or when the drum 1 is held stationary with the toner particles in the blade nip 2*n* adhering to the drum 1 due to the pressure of the cleaning blade 2 continuously applied thereto, the toner particles 12 disturb the pressure balance at the blade nip 2*n* and bring about defective cleaning.

Figure 19B:
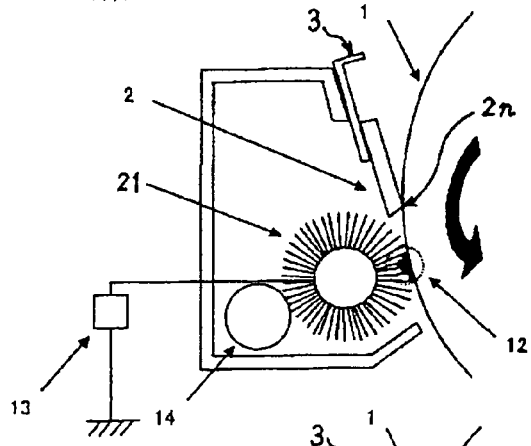

FIG. 19B shows a condition wherein the drum 1 is rotated in the direction opposite to the regular rotation direction adapted to form an image while conveying the toner particles 12 to the position where the cleaning brush 21 is held in contact with the drum 1. In this case, the continuous contact of the cleaning blade 2 with the drum 1 is not problematic. Also, the contact of the charger 4, developing unit 6 and image transferring device 7 with the drum 1 is not problematic either.

Figure 19C:
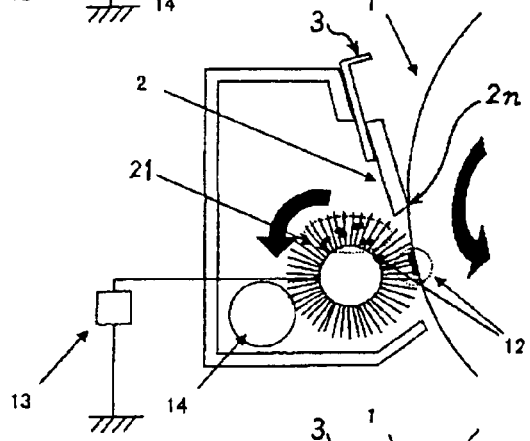

FIG. 19C shows a condition wherein the brush 21 is removing the toner particles 12, brought to the brush nip 21*n* between the cleaning brush 21 and the drum 1, while rotating in the direction opposite to the regular rotation direction of the drum 1. At this instant, a power supply bias or bias applying means 13 is applied to the cleaning brush 21 in order to bias it to polarity opposite to the regular polarity of the toner.

The toner particles 12 are residual toner left on the drum 2 after image transfer and therefore contain toner particles of polarity opposite to the regular polarity due to the influence of an image transfer bias. Therefore, although toner particles of regular polarity are electrostatically deposited on the cleaning brush 21 and removed thereby, the toner particles of opposite polarity are not deposited on the cleaning brush 21, but are evenly scattered on the drum 1 by the brush 21.

Figure 19D:
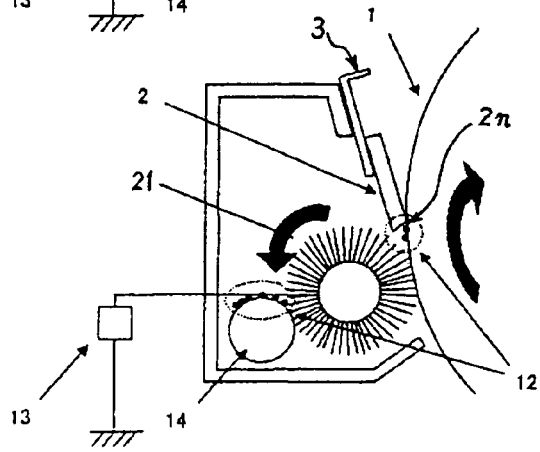

FIG. 19D shows a condition wherein the drum 1 is rotated in the regular direction with the toner particles 12 thus removed and evenly scattered thereon, and then the toner particles 12 are again removed by the cleaning blade 2. As shown, because the scattered toner particles is small in amount, they effect the scattering of the pressure of the cleaning blade 2 little even if accumulated in the wedge-shaped space at the blade nip 2*n* and can therefore be effectively removed.

Figure 20:
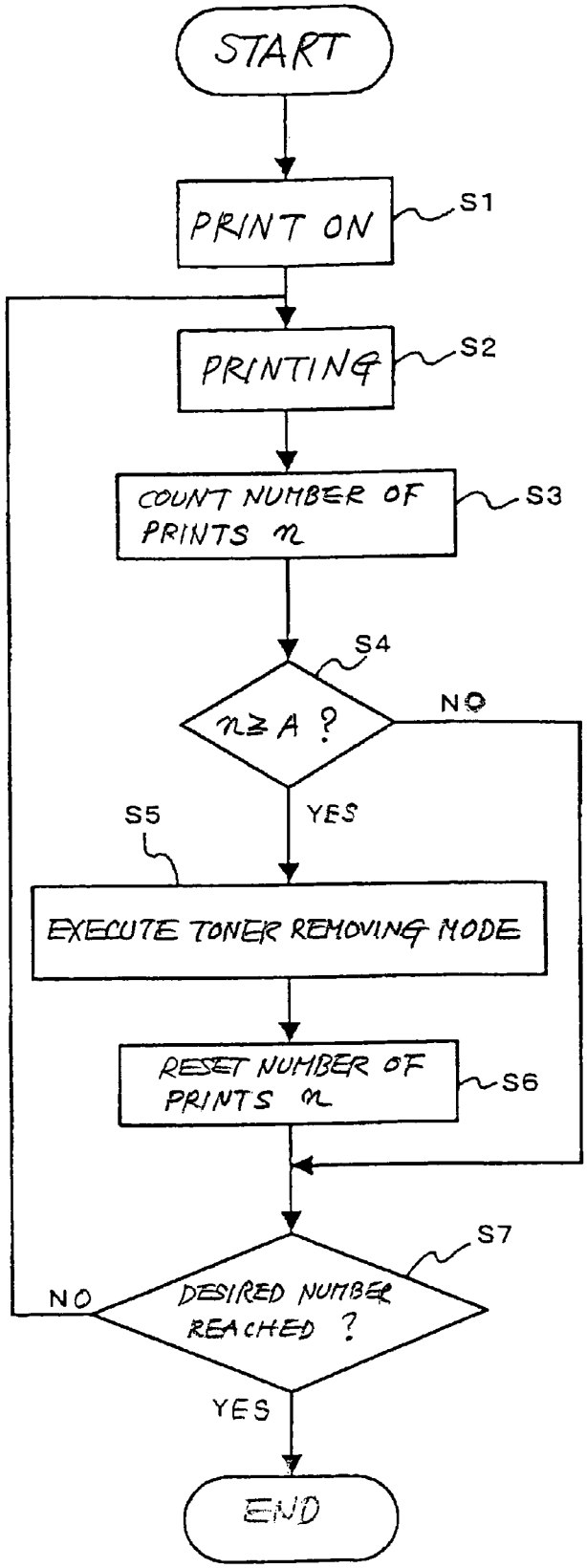
FIG. 20 is a flowchart showing the timing for moving the cleaning blade into or out of contact with the drum.

FIG. 20 demonstrates a specific procedure for executing a toner cleaning mode effected after a preselected number of times of image formation for selectively moving the cleaning blade 2 into or out of contact with the drum 1. As shown, when the operator of the printer inputs a desired number of prints and then pushes a print start switch, not shown, (step S1), the printer starts a printing operation (step S2) while counting the number of prints n output (step S4). When the number of prints n reaches or exceeds a preselected number A (YES, step S4), the toner cleaning mode for clearing accumulated toner, i.e., the operation described with reference to FIGS. 19A through 19D is executed (step S5).

After the step S5, the number of prints n is reset (step S6), and if the desired number of pints are output (YES, step S7), the toner cleaning mode of FIG. 20 ends; if otherwise (NO, step S7), the procedure returns to the step S2. If the number of prints n output is smaller than the preselected number (NO, step S7) and if the number of prints n is short of the desired number of prints (NO, step S7), the toner cleaning mode ends.

Figure 21:
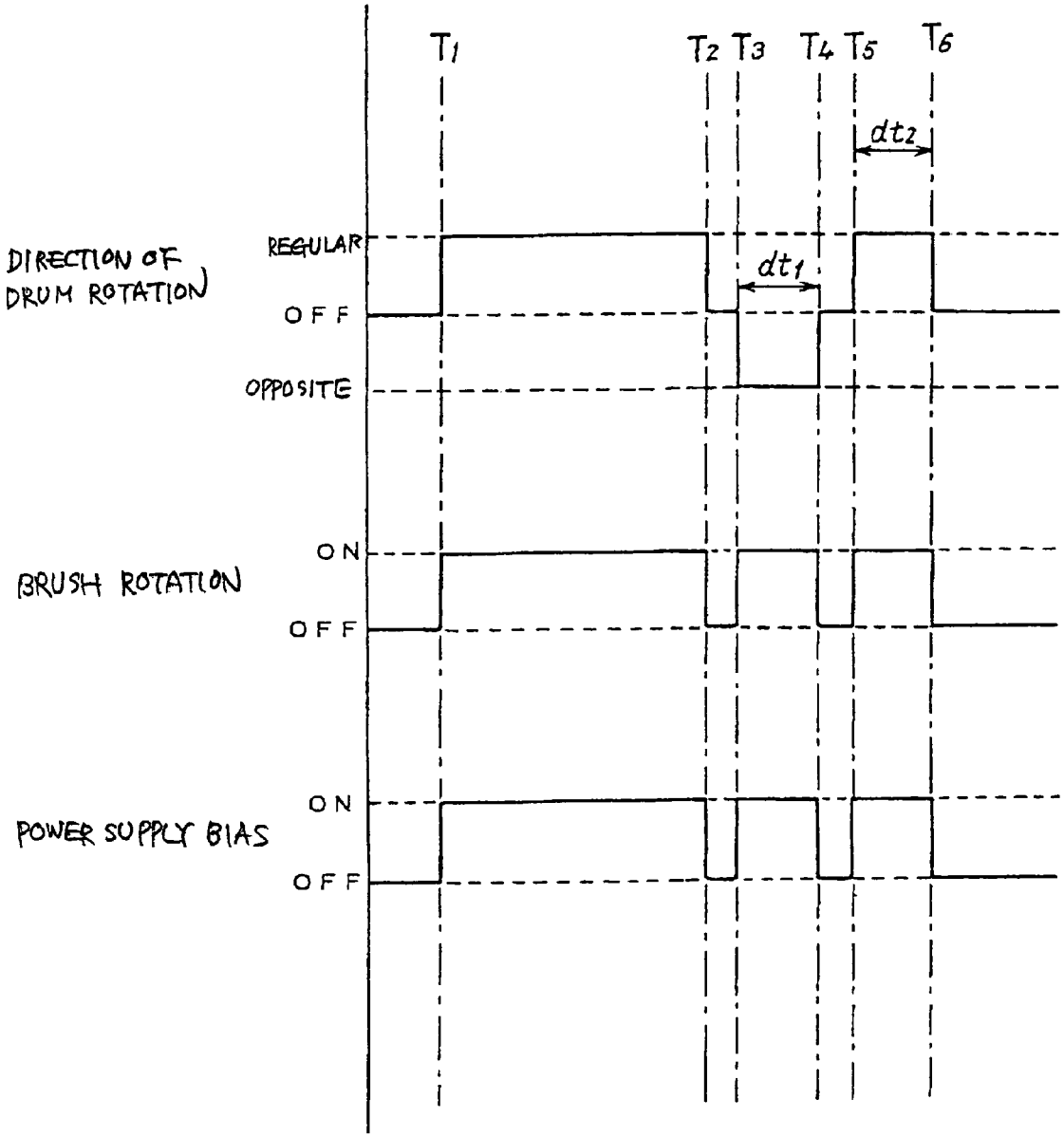
FIG. 21 is a timing chart showing the operations of the drum and cleaning brush and the application of a power supply bias occurring in the cleaning move.

FIG. 21 is a timing chart showing the operations of the drum 1 and cleaning brush 21 and the application of the power supply bias 13 effected during the toner cleaning mode operation. As shown, usual image formation is executed during a period of time between T1 and T2 while the toner cleaning mode is executed during a period of time of between T2 and T6. When the cleaning mode begins during image formation, the drum 1, rotating in the regular direction for image formation, is brought to a stop at time T2, as shown in FIG. 19*a*. The drum 1 is then caused to start rotating in the reverse direction opposite to the regular direction at time T3, as shown in FIG. 19B. As a result, the accumulated toner particles 12 are brought to the brush nip 21*n* by the drum 1 and then removed from the drum 1 by the cleaning brush 21 which is in rotation.

After the drum 1 has been rotated for a preselected period of time dt1, it is again brought to a stop at time T4 and then caused to start rotating in the regular direction at time T5, as shown in FIG. 19D. Finally, when the drum 1 is rotated for a preselected period of time dt2, the cleaning mode ends at time T6.

As shown in FIG. 19A, assume that the distance between the blade nip 2*n* and the brush nip 21*n* is L3, as measured on the surface of the drum 1, and that the surface of the drum 1 moves at a speed of v. Then, if the period of time dt1 is longer than a period of time of L3/v, the toner particles 12 accumulated at the blade nip 2*n* can be successfully conveyed to the brush nip 21*n*. Also, if the period of time dt2 is longer than a period of time of L3/v, the toner particles uniformly scattered on the drum 1 by the cleaning brush 21 can be surely brought to the blade nip 2*n*.

In FIG. 21, while the cleaning brush 21 and power supply bias 13 both are shown as being turned off between times T2 and T3 and T4 and T5, i.e., when the drum 1 is held in a halt, they may be held in an ON state throughout the usual image formation and cleaning mode. Further, while all operations are turned off when the cleaning mode ends at time T6, they may also be continuously held in an ON state because the operations between T5 and T6 and the operations between T1 and T2 are the same.

As stated above, in the cleaning mode, part of the toner particles 12 charged to opposite polarity due to the influence of image transfer are not deposited on the cleaning brush 21, but are uniformly scattered on the drum 1 by the brush 21. Such a small amount of toner particles left on the drum 1 are prevented from causing the cleaning blade 2 from rolling up during image formation following the toner cleaning mode operation.

More specifically, if all toner particles are removed from the drum 1 by the cleaning mode, the drum 1 and cleaning blade 2 are caused to directly contact each other during image formation following the cleaning mode. If the drum 1, thus directly contacting the cleaning blade 2, is rotated, the resulting great frictional force causes the blade edge 2*b* to be drawn in the direction of movement of the drum surface and bent or rolled up thereby. In this respect, some toner particles left on the surface of the drum 1, as stated above, enter the blade nip 2*n* between the drum 1 and the cleaning blade 2 during image formation following the toner cleaning mode, reducing the friction at the cleaning nip 2*n* with a lubricating function for thereby obviating roll-up.

In the illustrative embodiment, the cleaning mode is configured to leave toner particles on the drum 1 by an amount between 0.01 mg/cm$^2$ and 0.1 mg/cm$^2$. The printer 100 executes control such that an adequate amount of toner particles are left in accordance with the size of the bias.

If the amount of toner particles left on the drum 1 is less than 0.01 mg/cm$^2$, the friction acting between the cleaning blade 2 and the drum 1 at the blade nip 2*n* does not decreases and is apt to bring about roll-up. If the above amount is greater than 0.1 mg/cm$^2$, the drag force N2, tending to scatter the linear pressure with the toner particles 12, increase with the result that the peak pressure of the drag force N1 executed by the cleaning blade 2 on the drum 1 decreases, resulting in or often resulting in defecting cleaning. Consequently, the cleaning mode must be frequently executed.

The polarity of the bias, shown and described as being one opposite to the regular polarity of toner, may be one identical with the regular polarity, if desired. In such a case, although toner particles of opposite polarity are mainly removed from the drum 1, the toner particles are removed from the drum 1 by the mechanical friction of the cleaning brush 21 also, so that control is so executed as to leave an adequate amount of toner particles in accordance with the size of the bias.

The implement for causing an adequate amount of toner particles to be left on the drum 1 is not limited to the polarity or the size of the bias to be applied. Alternatively, the mechanical removing ability of the cleaning brush 2, e.g., the density of the amount of bite of the cleaning brush 2 or the speed ratio between the brush 2 and the drum 1 may be controlled to leave an adequate amount of toner particles during the cleaning mode operation.

By maintaining the amount of toner particles 12 accumulated at the blade nip 2*n* below a preselected amount with the cleaning brush 21, as stated above, it is possible to obviate defective cleaning. The toner cleaning mode stated above may be periodically effected at preselected intervals or effected, if the image area ratio and therefore the amount of residual toner particles is great, every time in order to surely obviate defective cleaning, if desired. Further, the toner cleaning mode may be effected only when the surface of the drum 1 is rotated a preselected number of times.

As shown in FIGS. 19A through 19D, the toner particles, labeled 14, collected by the cleaning brush 21 are elecrtrostatically moved by a collection roller 14 and then removed by a blade member not shown. At this instant, the toner particles do not have to be fully removed from the collection roller 14.

In the illustrative embodiment, as for the cleaning brush 21, the bristle length of the cleaning brush 21 is selected to be between 0.2 mm to 20 mm, preferably 0.5 mm to 10 mm. If the bristle length is greater than 20 mm, the tilt angle of the brush body in the reverse direction decreases and causes the bristles to fall down due to the repeated sliding friction of the cleaning brush 21 with the drum 1, thereby degrading the cleaning ability. On other hand, brush length of below 0.2 mm cannot sufficiently exert a physical force on the drum 1. The brush length of between 0.2 mm and 20 mm, preferably between 0.5 mm and 10 mm, enhances the removal of the toner particles 12 from the drum 12 and the deposition of the former on the latter.

Figure 22:
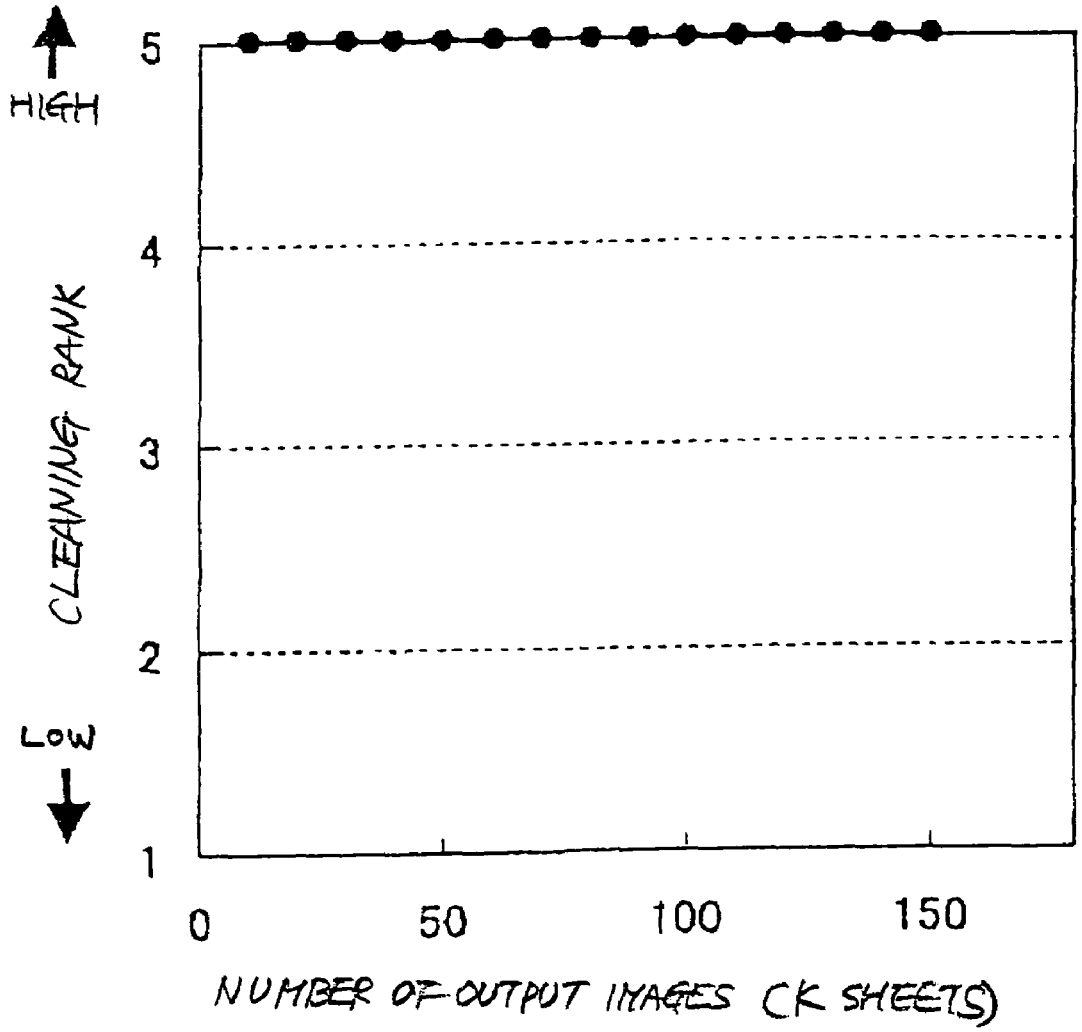
FIG. 22 is a graph showing the results of durability tests conducted with the cleaning blade with the obtuse edge in the cleaning mode.

FIG. 22 is a graph similar to FIG. 16, showing the results of durability tests conducted to determine how the cleaning ability of the cleaning blade 2 having the obtuse edge angle varies due to aging. In FIG. 22, the ordinate and abscissa indicate the cleaning ability and the number of images produced, respectively. For the durability tests, the digital printer imagio NEO 352 mentioned previously was used to form a horizontal stripe image with an image area of 5% on an A4, landscape paper sheet while toner left on the drum 1 after cleaning was observed by eye for evaluating the cleaning ability in ranks. The higher the rank, the higher the cleaning ability; rank 5 indicates perfect cleaning while rank 1 indicates defective cleaning occurred over the entire surface.

Further, the toner cleaning mode for removing accumulated toner particles was periodically executed at preselected intervals. As shown in FIG. 20, it was found that defective cleaning did not occur up to 150,000 times (prints) of image formation.

While in the illustrative embodiment use is made of spherical toner particles with a diameter small enough to enhance resolution and image transfer and produced by polymerization, polymerization may, of course, be replaced with conventional, mechanical pulverization.

To clear spherical toner particles, a pressure force must be made higher than when pulverized toner particles are used, as stated previously. The higher pressure force is, of course, apt to wear the surface of the drum 1. To solve this problem, the illustrative embodiment uses a drum provided with a protection layer on the surface thereof, as will be described hereinafter.

Figure 23:
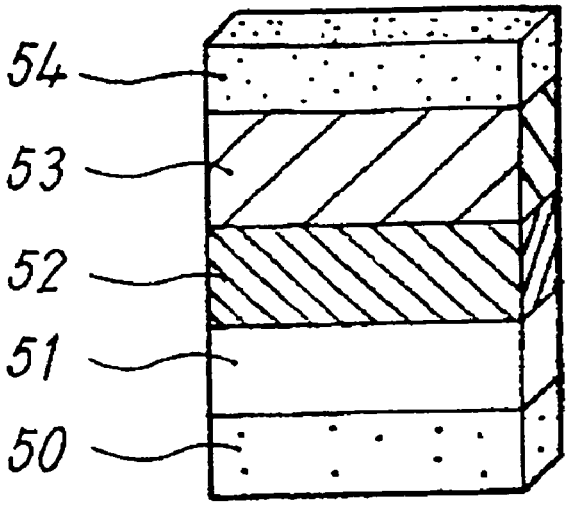
FIG. 23 is a section showing a specific structure of the drum.

FIG. 23 is a section showing a specific configuration of the drum 1 included in the illustrative embodiment. As shown, the drum 1 includes a base layer 51 formed on a conductive support 50 and formed of an insulator, a photoconductive layer made up of a charge generating layer 52 and a charge transport layer 53 formed on the base layer 51 and a protection layer 54 formed on the surface of the drum 1.

The conductive support 50 may formed of a conductor exhibiting conductivity of $10^{10}$ Ω·cm or below in terms of volume resistivity. While the photoconductive layer 52 may be implemented as either one of a single layer or a stack of two more layers, the following description will first concentrate on a stack configuration made up of the charge generating layer 52 and charge transport layer 53. The charge generating layer 52 is mainly formed of any one of conventional charge generating substances including amonoazo pigment, disazo pigment, trisazo pigment, perylene pigment, porynone pigment, quinocridone pigment, quinine-condensed polycyclic compound or similar phthalocyanine pigment, naphthalocyanine pigment or azurenium-salt pigment. Tow or more of such charge generating substances may be used in combination, if desired.

The charge generating layer 52 may be formed by dispersing a charge generating substance with or without a binder resin in a suitable solvent stored in a ball mill, an attriter or a sand-mill or by an ultrosolic wave, coating the resulting dispersion on the base layer 51 and then drying it. To coat the dispersion, use may be made of any one of immersion coating, spray coating, beat coating, nozzle coating, spinner coating, ring coating or similar conventional technology. The charge generating layer 52 should suitably be between 0.1 μm and 5 μm thick, preferably between 0.1 μm and 2 μm.

The charge transport layer 53 may be formed by dissolving or dispersing a charging transporting substance and a binder resin in a suitable solvent, coating the resulting dispersion on the charge generating layer 52 and then drying it. One or two or more plasticizers, leveling agents, antioxidants or the like may be added to the above dispersion, as needed. The charge transporting substance should be contained in an amount between 20 parts by weight and 300 parts by weight, preferably 40 parts by weight and 150 parts by weight for 100 parts by weight of the binder resin. The thickness of the charge transporting layer 53 should preferably be 25 μm or below from the standpoint of resolution and response; the lower limit should preferably be 5 μm or above although it depends on the system, including a charge potential, to be used.

In the case where the photoconductive layer is implemented by a single layer, it may be formed by dissolving or dispersing the previously mentioned charge generating substance, charge transporting substance and binder resin in a suitable solvent, coating the resulting dispersion on the conductive support 50 or the base layer 51 and then drying it. The charge transporting layer may not be included in the photoconductive layer, if desired. Also, a plasticizer, a leveling agent, an antioxidant or the like may be added, if necessary.

The binder resin may be the binder resin mentioned in relation to the charge generating layer 52 instead of the binder resin mentioned in relation to the charge transporting layer 53. 5 parts by weight to 40 parts by weight of charge generating substance should preferably be contained for 100 parts by weight of binder resin. The charge transporting layer should preferably be contained in an amount of 0 parts by weight to 190 parts by weight, more preferably 50 parts by weight to 150 parts by weight, for 100 parts by weight of the binder resin.

To form the photoconductive layer, a coating liquid may be produced by, e.g., dispersing a charge generating substance and a binder resin in tetrahydrofurane, dichloroethane, cyclohexan or similar solvent and then coating it by immersion coating, spray coating, bead coating, ring coating or similar technology. The photoconductive layer should preferably be 5 μm to 25 μm thick.

While the base layer or underlayer 51 is generally, mainly formed of resin, the resin should preferably be highly resistant to organic solvents in general in consideration of the fact that the photoconductive layer is coated thereon by a solvent. Such a resin may be selected from water-soluble resins including polyvinyl alcohol, casein and sodium polyacrylate, alcohol-soluble resins including copolymerized nylon and methoxy-methyl nylon and cure resins with a three-dimensional network including polyurethane, melamine resin, phenol resin, alkyd-melamine resin and epoxy resin.

A powdery pigment represented by titan oxide, silica, alumina, zirconium oxide, tin oxide, indium oxide or similar metal oxide may be added to the base layer 51 in order to reduce moiré and residual potentials. Further, the base layer 51 may be formed by suitable solving and coating method like the photoconductive layer stated previously.

The base layer 51 of the drum 1 may be formed of silane coupler, a titanium coupler, chromium coupler or the like or may advantageously be formed of $Al_2O_3$ provided by anodization or polyparaxylene (parylene) or similar organic substance or $SiO_2$, $SnO_2$, $TiO_2$, ITO, $CeO_2$ or similar inorganic substance provided by a vacuum thin-film method. The base layer 51 should preferably be 0 μm to 5 μm thick.

The protection layer 54, formed on the surface of the drum 54 for a protection purpose, may advantageously be implemented by a protection layer having a bridged structure as a binder structure. As for the bridged structure, a reactive monomer, containing a plurality of bridging functional groups in a single molecule is used for causing a bridging reaction by use of optical or thermal energy in order to form a three-dimensional network. This network plays the role of a binder and exhibits high resistivity to wear.

Considering electric stability, print-durability and service life, it is extremely effectively to use as the above monomer a monomer entirely or partly having a charge transporting function. Such a monomer forms a charge transporting portion in the network for thereby sufficiently exhibiting the function expected of the protection layer 54.

The reactive monomer with the charge transporting function may be any one of, e.g., a compound having at least one charge transporting component and at least one silica atom with a hydrolytic substituent in a single molecule, a compound having a charge transporting substance and a hydroxyl group in a single molecule, a compound having a charge transporting substance and a carboxyl group in a single molecule, a compound having a charge transporting component and an epoxy group in a single molecule and a compound having a charge transporting agent and an isocyante group in a single molecule. Such charge transporting materials may be used alone or in combination, as desired.

More preferably, for the monomer with the charge transporting function, use may be advantageously be made of a reactive monomer having a triarylamine structure in consideration of the fact that it is electrically, chemically stable and allows a carrier to migrate at high speed.

Further, there may be used in combination any conventional polymeric monomer or any conventional polymeric oligomer in order to control viscosity at the time of coating, to reduce the stress of the bridged charge transporting layer and to reduce surface energy or a coefficient of friction.

As for the drum 1, the polymerization or the bridging of a hole transporting compound is effected by heat or light. While polymerization by heat proceeds only by heat or needs a polymerization starter, it is preferable to add a polymerization starter for enhancing efficient reaction at lower temperature. As for polymerization using light, although ultraviolet rays are preferable, the reaction rarely proceeds only by optical energy and generally needs an optical polymerization starter. In this case, the polymerization starter generates radicals, ions or similar active seeds by absorbing mainly ultraviolet rays having a wavelength of 400 nm or below, thereby starting polymerization. In the illustrative embodiment, the thermal polymerization starter and optical polymerization starter may be used in combination, if desired.

Although the charge transporting layer 53 with the network structure thus formed has high wear resistance, it decreases noticeably decreases in volume during bridge reaction and is therefore apt to crack or otherwise damaged if too thick. In such a case, the protection layer 54 may be made up of a lower layer, facing the photoconductive layer, formed of a low-molecule dispersed polymer and an upper layer, facing the surface, implemented as a protection layer having a bridge structure. In this alternative structure, an image carrier or photoconductive element whose surface layer is implemented by an extremely hard layer may be used so as to be protected from shaving by the cleaning blade 2 without loosing the function of a photoconductive element layer.

The illustrative embodiment achieves various unprecedented advantages described above with unique configurations.

Second Embodiment

Figure 24:
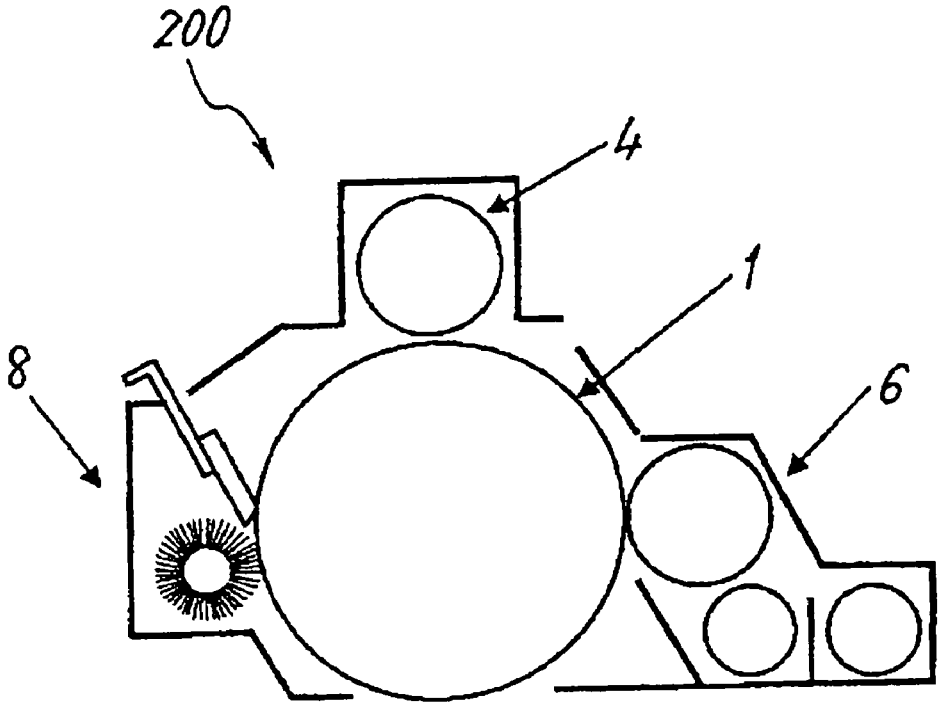
FIG. 24 is a section showing a second embodiment of the image forming apparatus in accordance with the present invention.

Reference will be made to FIG. 24 for describing an alternative embodiment of the image forming apparatus in accordance with the present invention. As shown, the printer 100 includes a process cartridge, generally 200, supporting at least the drum 1 and cleaning device 8 and removably mounted to the printer body not shown. In the illustrative embodiment, the process cartridge 200 additionally supports the charger 4 and developing unit 6. As for the basic construction, the printer 100 is substantially identical with the printer 100 shown in FIG. 1.

While the process cartridge 200 generally needs a space for accommodating waste toner collected by the cleaning unit 8, the illustrative embodiment, capable of using spherical toner, has high image-transfer efficiency and leaves a minimum of residual toner and can therefore reduce the amount of waste toner, compared to the conventional pulverized toner.

It has heretofore been difficult with a process cartridge capable of supporting only small-size cleaning means due to a limited space to use spherical toner because it is apt to cause defective cleaning to occur. By contrast, the illustrative embodiment can effect cleaning with a simple configuration despite the use of spherical toner and can therefore be loaded with the process cartridge 200 of the type using spherical toner. This is successful to reduce the space to be allocated to the waste toner in the process cartridge 200 for thereby making the process cartridge 200 compact.

Further, an electrostatic image forming apparatus of the type described has a sophisticated construction and makes it difficult to replace various units mounted thereon. The illustrative embodiment promotes easy replacement because it uses the process cartridge 200 on which various units are mounted together.

As stated above, in the illustrative embodiment, at least the cleaning unit 8 and drum 1 are constructed into a single process cartridge 200 removable from the printer body. This allows the image carrier, charging means, developing means and cleaning unit to be integrally mounted on the process cartridge 200 and easily replaced by the user. In addition, the illustrative embodiment enhances the convenient use and efficient maintenance of the printer 100.

Third Embodiment

Figure 25:
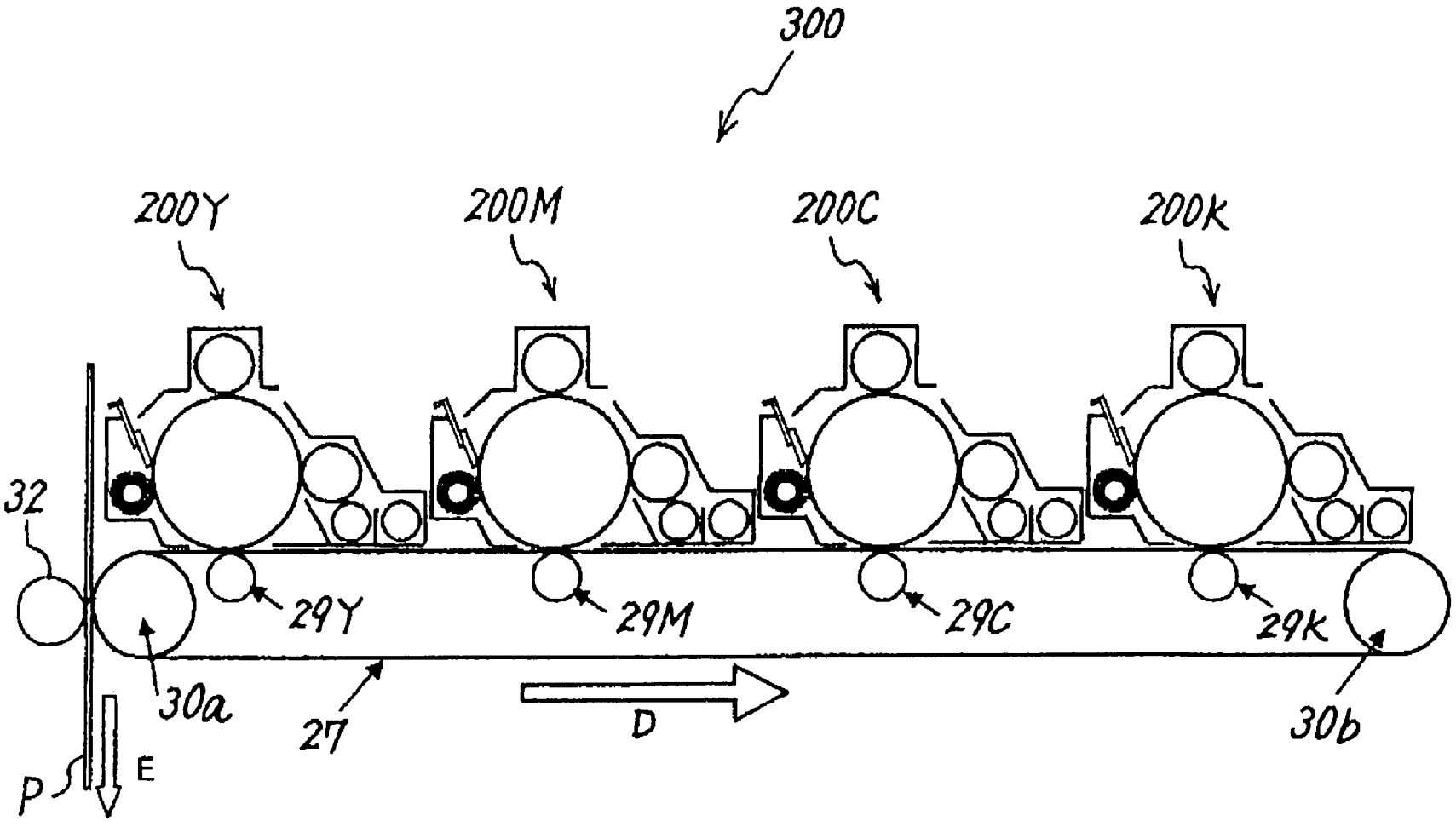
FIG. 25 is a view showing the general construction of a third embodiment of the image forming apparatus in accordance with the present invention.

FIG. 25 shows a third embodiment of the image forming apparatus in accordance with the present invention implemented as a color printer including process cartridges 200 each having the configuration shown in FIG. 24. As shown, the color printer, generally 300, includes an intermediate image transfer belt (simply belt hereinafter) 27 passed over a plurality of rollers 30*a* and 30*b* and extending in the horizontal direction when the color printer 300 is positioned on a horizontal surface. The belt 27 is driven to turn in a direction indicated by an arrow D in FIG. 25. Four process cartridges 200 are arranged side by side in the horizontal direction in which the belt 27 extends, and each uses toner of particular color. More specifically, a Y (yellow) process cartridge 200Y, an M (magenta) toner cartridge 200M, a C (cyan) process cartridge 200C and a (black) process cartridge 200K are arranged in this order from the left to the right in FIG. 25.

In operation, a toner image formed on each drum 1 of each process cartridge in a particular color is transferred from the drum 1 to the belt 27 by an electric field for image transfer formed by corresponding one of primary image transfer devices 20Y through 29K, which are positioned to face the drums 1 via the belt 27. More specifically, a black toner image, a cyan toner image, a magenta toner image and a yellow toner image are sequentially transferred from the drums 1 to the belt 27 while overlapping each other, completing a full-color image on the belt 27. The full-color image thus formed is conveyed by the belt 27 to a secondary image transfer position facing a secondary image transfer device 32.

A paper sheet or similar recording medium P is conveyed to the secondary image transfer position in a direction E in synchronism with the leading edge of the full-color image. The full-color image is then transferred from the belt 27 to the paper sheet P by an electric field formed by the secondary image transfer device 32 and then driven out of the printer body not shown.

While the Y, M, C and B process cartridges 200Y through 200K are arranged from the upstream side toward the downstream side in the direction in which the surface of the belt 27 moves, such an order is only illustrative and may be changed, as desired.

Fourth Embodiment

Figure 26:
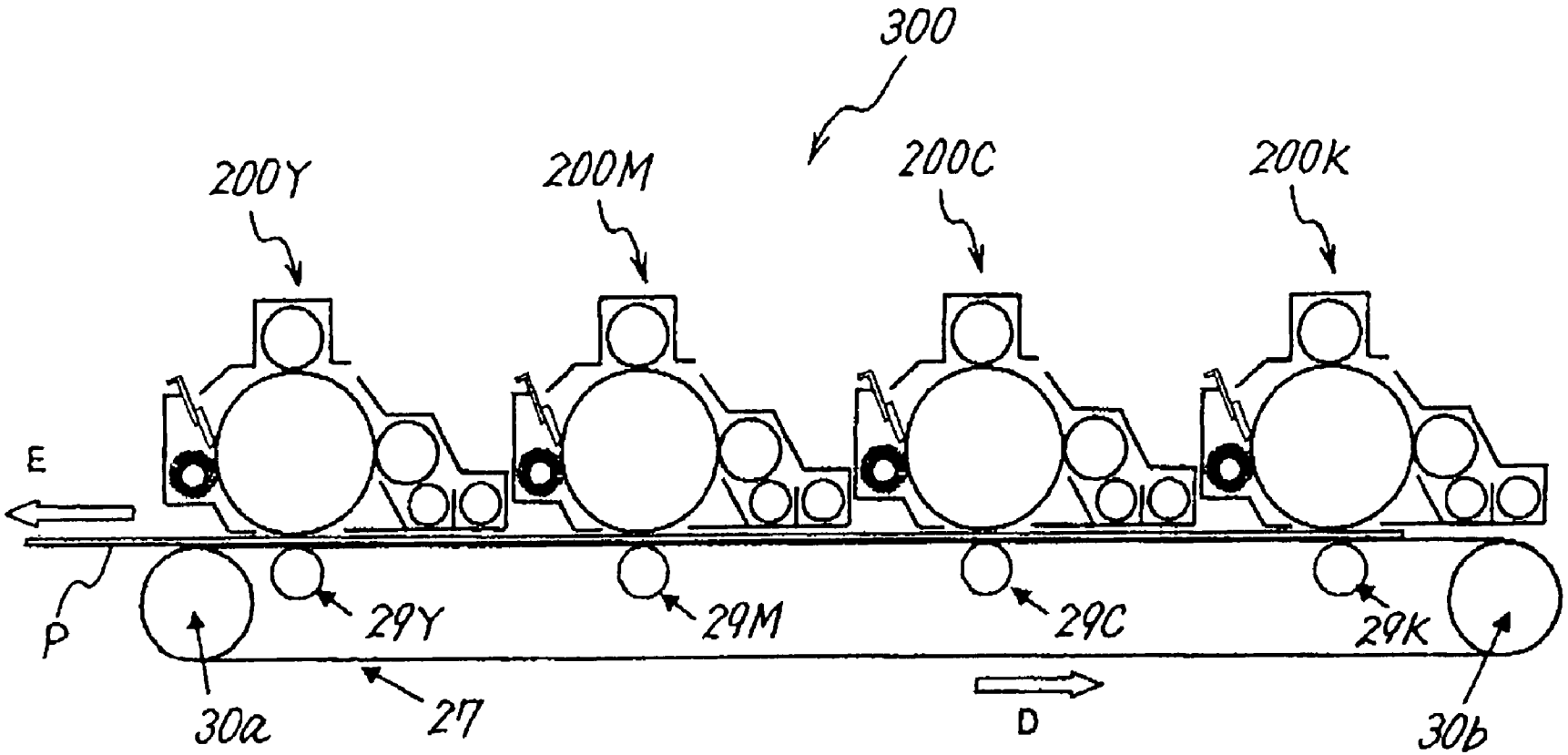
FIG. 26 is a view showing the general construction of a fourth embodiment of the image forming apparatus in accordance with the present invention.

A fourth embodiment of image forming apparatus in accordance with the present invention will be described with reference to FIG. 26. As shown, the fourth embodiment is also implemented as a color printer 300 including four process cartridges like the third embodiment.

As shown, the color printer 300 includes, in place of the belt 27 of the third embodiment, a sheet or medium conveying belt 34 capable of turning while carrying the paper sheet P on its surface. In the illustrative embodiment, the toner images are directly transferred from the drums 1 of the process cartridges 200Y through 200K to the paper sheet P in accurate register with each other. Of course, the process cartridges 200Y through 200K may be arranged in any desired order.

Fifth Embodiment

Figure 27:
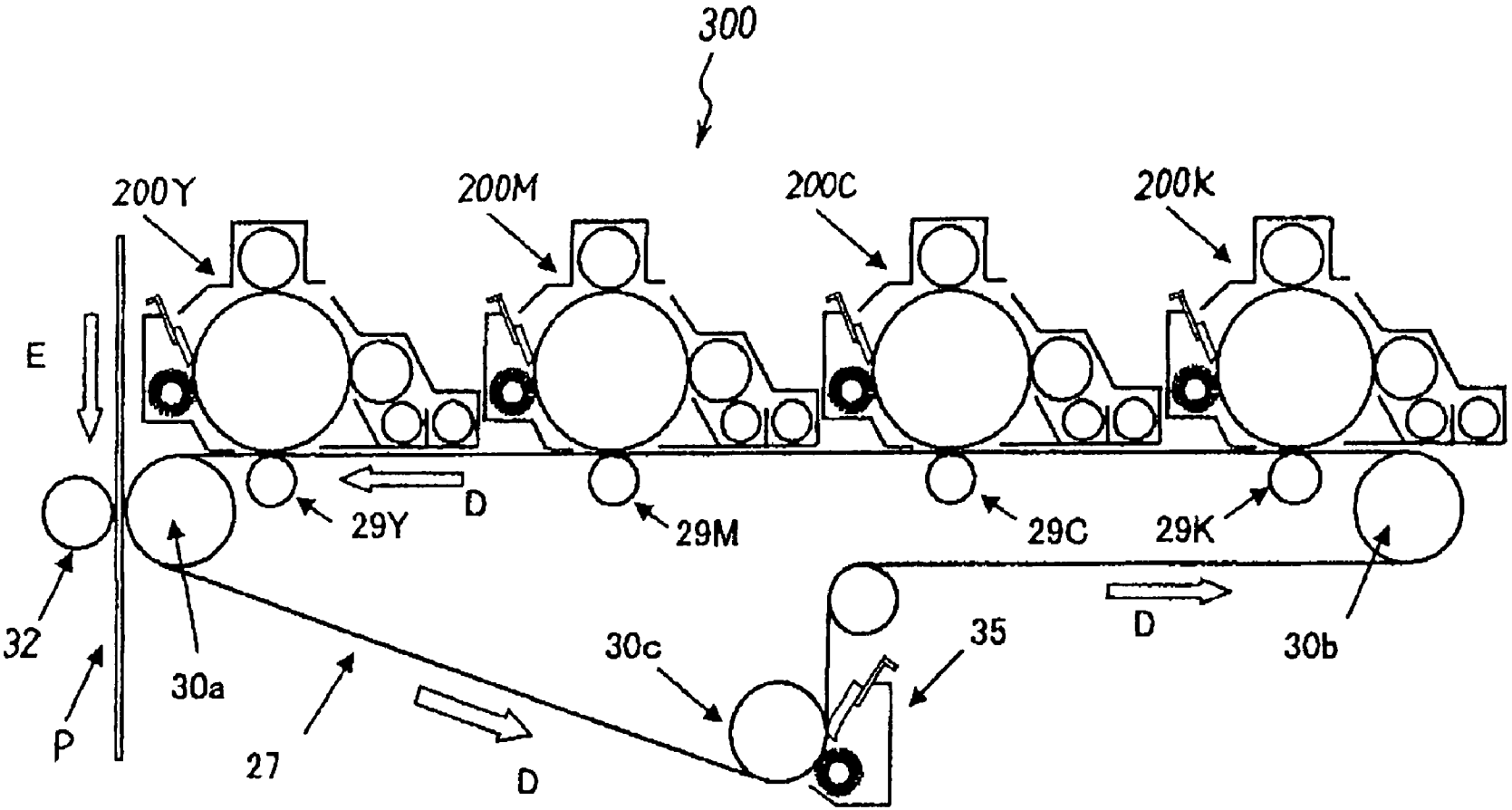
FIG. 27 is a view showing the general construction of a fifth embodiment of the image forming apparatus in accordance with the present invention

Referring to FIG. 27, a fifth embodiment of the image forming apparatus in accordance with the present invention is shown and also implemented as a printer 300 using the process cartridge 200 of the second embodiment. As shown, a belt cleaning unit 35 similar in configuration to the leaning unit 8 assigned to the drum 1 is used to clean the surface of the belt 27.

More specifically, in the illustrative embodiment, the toner images of different colors are sequentially transferred to the paper sheet P being conveyed by the belt 27 as in the third embodiment. The belt cleaning unit 35, characterizing the illustrative embodiment, removes toner particles left on the surface of the belt 27 after the secondary image transfer effected by the secondary image transfer device 32. The belt cleaning unit 35 includes a cleaning blade contacting the surface portion of the belt 27 passed over the roller 30*c*.

The belt cleaning unit 35 with the above configuration is capable of efficiently, surely cleaning even spherical toner particles left on the surface of the belt or image carrier 27. A cleaning unit similar in configuration to the belt cleaning unit 35 may be assigned to the sheet or medium conveying belt of the previous embodiments, if desired.

In summary, it will be seen that in accordance with the present invention a pressure force with which a cleaning blade contacts an image carrier is prevented from being scattered, so that the peak pressure can be maintained. This allows spherical toner to be stably cleared over a long period of time.

Various modifications will become possible for those skilled in the art after receiving the teachings of the present disclosure without departing from the scope thereof.

What is claimed is:

1. An image forming apparatus comprising:

a toner image carrier whose surface is movable while carrying a toner image thereon;

cleaning means including a cleaning blade held in contact with the surface of said toner image carrier in a counter direction for removing toner particles left on said surface; and toner accumulation preventing means for preventing the toner from accumulating at a blade contact portion where said toner image carrier and said cleaning blade contact each other;

wherein the toner, forming the toner image, comprises spherical toner having circularity of 0.98 or above, and two surfaces of said cleaning blade, forming a ridge line contacting said image carrier, form an obtuse edge angle with each other before the cleaning blade is positioned for use by contacting said toner image carrier.

2. The apparatus as claimed in claim 1, wherein said toner image carrier comprises a latent image carrier.

3. The apparatus as claimed in claim 1, wherein said toner image carrier comprises an intermediate image transfer body.

4. The apparatus as claimed in claim 1, wherein said obtuse edge angle is between 95° and 120°.

5. The apparatus as claimed in claim 1, wherein said cleaning blade has rubber hardness of between 65° and 80° in JIS (Japanese Industrial Standards)-A scale.

6. The apparatus as claimed in claim 1, wherein said cleaning blade has a modulus of repulsive elasticity of 30% or below at normal temperature of 24° C.±3° C. and varies by a ratio of 350% or below in a range of from 10° C. to 40° C.

7. The apparatus as claimed in claim 1, wherein said cleaning blade exerts a linear pressure of 0.50 N/cm or above on said toner image carrier when said toner image carrier is held in a halt.

8. The apparatus as claimed in claim 1, wherein at least said cleaning means and said toner image carrier are constructed into a single process cartridge removably mounted to an apparatus body.

9. The apparatus as claimed in claim 1, wherein a surface layer, forming the surface of said toner image carrier, comprises a protection layer implemented by a binder resin having a bridged structure, and the binder resin contains a charge transporting substance in the structure thereof.

10. The apparatus as claimed in claim 1, further comprising:

toner removing means for removing the toner from the surface of said image carrier at a side upstream of said blade contact portion in a regular direction of movement of the surface of said image carrier;

removal control means for moving the surface of said toner image carrier in an opposite direction opposite to the regular direction for thereby causing said surface to convey accumulated toner accumulated at the side upstream of said blade contact portion to a position where said toner removing means is positioned, whereby said accumulated toner is removed by said toner removing means;

wherein said toner removing means and said removal control means constitute said toner accumulation preventing means.

11. The apparatus as claimed in claim 10, wherein a toner removing mode for removing the accumulated toner starts after an image forming operation has ended.

12. The apparatus as claimed in claim 10, wherein said removal control means causes said toner removing means to remove the toner from the surface of said toner image carrier such that said toner remains on said surface of said toner image carrier in an amount of between 0.01 mg/cm$^2$ and 0.1 mg/cm$^2$.

13. The apparatus as claimed in claim 10, wherein a toner removing mode for removing the accumulated toner starts when the surface of said toner image carrier is rotated a preselected number of times.

14. The apparatus as claimed in claim 10, wherein said toner removing means comprises a brush member configured to remove the toner from the surface of said toner image carrier while rotating in contact with said surface.

15. The apparatus as claimed in claim 14, further comprising bias applying mans for applying a voltage to said brush member;

wherein when the surface of said toner image carrier is moved in the opposite direction, said brush member is caused to rotate and applied with a bias of a same polarity as a regular electrification characteristic of the toner, which is assigned to usual image formation, from said bias applying means.

16. The apparatus as claimed in claim 14, further comprising bias applying means for applying a voltage to said brush member;

wherein when the surface of said toner image carrier is moved in the opposite direction, said brush member is caused to rotate and applied with a bias of an opposite polarity as a regular electrification characteristic of the toner, which is assigned to usual image formation, from said bias applying means.

17. The apparatus as claimed in claim 14, wherein bristles of said brush have a length between 0.5 mm and 10 mm.

* * * * *